US005752694A

United States Patent [19]

Yamashita et al.

[11] Patent Number: 5,752,694

[45] Date of Patent: May 19, 1998

[54] SHEET POST-TREATMENT APPARATUS AND IMAGE FORMING APPARATUS WITH IT

[75] Inventors: Hirofumi Yamashita, Inba-gun; Yuji Sasanuma, Tsukuba-gun, both of Japan

[73] Assignees: Canon Aptex Inc., Ibaraki-ken; Tohoku Ricoh Co., Ltd., Miyagi-ken, both of Japan

[21] Appl. No.: 437,392

[22] Filed: May 11, 1995

[30] Foreign Application Priority Data

May 16, 1994 [JP] Japan ..... 6-127047

[51] Int. Cl.[6] ..... B65H 39/02

[52] U.S. Cl. ..... 270/58.12; 270/58.13; 270/58.19; 270/58.28

[58] Field of Search ..... 270/58.01, 58.07, 270/58.08, 58.11, 58.12, 58.13, 58.14, 58.19, 58.28

[56] References Cited

U.S. PATENT DOCUMENTS 4,986,520 1/1991 Shido et al. ..... 270/58.14

5,106,067 4/1992 Higaki ..... 270/58.08

5,190,274 3/1993 Kamamoto et al. ..... 270/58.09

5,248,136 9/1993 Hamanaka ..... 270/58.14

5,362,200 11/1994 Ushirogata ..... 270/58.14 X

*Primary Examiner*—Hoang Nguyen

*Attorney, Agent, or Firm*—Fitzpatrick, Cella, Harper & Scinto

[57] ABSTRACT

A sheet post-treatment apparatus with a sorting apparatus for containing sheets discharged in a plurality of sort bins, a connecting unit for introducing sheets discharged into the sorting apparatus, a sheet discharge tray for use in a non-sort mode provided independently of the sorting apparatus for piling thereon the sheets discharged, and a changeover device for selectively changing over bewteen a first mode for introducing the sheets discharged into the sorting apparatus through the connecting unit, and a second mode for introducing the sheets into the sheet discharge tray when in a non-sort mode.

27 Claims, 24 Drawing Sheets

UPON SORTING

UPON NON-SORTING

| |
|---|
| FIG. 13A |
| FIG. 13B |

| |
|---|
| FIG. 14A |
| FIG. 14B |

| |
|---|
| FIG. 15A |
| FIG. 15B |

SHEET POST-TREATMENT APPARATUS AND IMAGE FORMING APPARATUS WITH IT

BACKGROUND OF THE INVENTION

1. Field of the Invention

This invention relates to a sheet post-treatment apparatus, especially to one having the function of classifying sheets (such as paper leaves and brochures) outputted (discharged) from a sheet output apparatus and containing them in sort bins, and further the function of finding sheet bundles classified and contained in the sort bins. The sheet output apparatus is, for example, an image forming apparatus such as a printing apparatus or a copying apparatus, or a classifying apparatus such as a collator for classifying and assorting documents, catalogs, etc, and the sheet post-treatment apparatus is a sorting apparatus (sorter) of the bin unit shift type or the like having a number of sort bins.

1. Related Background Art

In an apparatus according to the prior art shown in FIG. 20 of the accompanying drawings, the reference numeral 100 designates a printing apparatus, a copying apparatus or the like as a sheet output apparatus, and the reference numeral 200 denotes a sheet post-treatment apparatus of the bin unit type connected to the sheet outlet 101 side of the sheet output apparatus.

Sheets on which printing or copying has been effected by the operation of the sheet output apparatus are successively discharged from the sheet outlet 101 by sheet discharge rollers 102. The sheet receiving port 201 of the sorting apparatus 200 faces the sheet outlet 101 of the sheet output apparatus 100, and the discharged sheets from the sheet output apparatus 100 enter the sorting apparatus 200 through the sheet receiving port 201 and are drawn into the sorting apparatus by the draw-in rollers 202 of the sorting apparatus.

In the sorting apparatus 200, the reference numeral 203 designates a sheet route changeover flapper, the reference numeral 204 denotes a sheet pass for non-sort, the reference numeral 205 designates a sheet kick-out rollers for non-sort, the reference numeral 206 denotes a sheet pass for sort, and the reference numeral 207 designates sheet kick-out rollers for sort underlying the rollers 205. These members 201 to 207 are disposed in place relative to a sorting apparatus body 208.

The reference numeral 209 denotes a bin unit comprising a plurality of sort bins $\mathbf{210}_1$ to $\mathbf{210}_n$ disposed in vertically multiple stages. This bin unit 209 is vertically movable relative to the sorting apparatus body 208 and is moved up and down relative to the sorting apparatus body 208 by an ascend/descend mechanism (not shown) including a motor M, a lead cam, etc.

a) During Non-sort Mode

When the non-sort mode is designated, the bin unit 209, with the uppermost first bin $\mathbf{210}_1$ as a non-sort bin, is moved to and held at such a level that the first bin $\mathbf{210}_1$, corresponds to the position of the sheet kick-out rollers 205 for non-sort as indicated by solid lines. The flapper 203 is changed over to and held in a posture for guiding the sheets drawn in by the sheet draw-in rollers 202 toward the sheet pass 204 for non-sort. Thereby, the sheets introduced from the sheet output apparatus 100 into the sorting apparatus 200 are all fed onto the uppermost first bin $\mathbf{210}_1$ as the non-sort bin of the bin unit 209 by the sheet kick-out rollers 205 for non-sort and are piled thereon.

b) During Sort Mode

When the sort mode is designated, the bin unit 209 is moved to such a level that the uppermost first bin $\mathbf{210}_1$ as the non-sort bin corresponds to the position of the sheet kick-out rollers 207 for sort. The flapper 203 is changed over to and held in a posture for guiding the sheets drawn in by the sheet draw-in-rollers 202 toward the sheet pass 206 for sort. Thereby, the first sheet introduced from the sheet output apparatus 100 into the sorting apparatus 200 is first fed onto the first bin $\mathbf{210}_1$ by the sheet kick-out rollers 207 for sort.

The bin unit 209 is moved up by an amount corresponding to one bin by the operation of the ascend/descend mechanism including the motor M, the lead cam, etc. in synchronism with the sheet feeding from the sheet output apparatus and also becomes ready to receive the sheet at the position of the sheet kick-out roller 207 for sort with the frontage between predetermined sort bins opened as is well known. When the feeding of the sheet onto the first bin $\mathbf{210}_1$ is terminated, the bin unit 209 is moved up by an amount corresponding to one bin, and at the position of the sheet kick-out rollers 207, the frontage between the first bin $\mathbf{210}_1$ and the second bin $\mathbf{210}_2$ is opened and the next sheet is fed onto the second bin $\mathbf{210}_2$.

Such ascending movement of the bin unit 209 by an amount corresponding to one bin and the opening of the frontage between adjacent bins are sequentially executed, whereby the feeding of the sheets of the first page onto respective bins from the first bin $\mathbf{210}_1$ to a bin at a stage corresponding to a predetermined number of sheets in the bin unit 209 is sequentially done.

For the feeding of a sheet of the second page onto each bin, in the case of the present example, the bin unit 209 which has been moved up is moved down and the first bin $\mathbf{210}_1$ is returned to the level corresponding to the position of the sheet kick-out rollers 207 for sort. Thereby, the time for the ink of the printed sheet distributed onto each sort bin to dry is earned, whereby the rubbing or the like of the print by the frictional contact with the next distributed sheet can be prevented. In this manner, the ascent and descent of the bin unit 209 are repetitively executed, whereby each of a predetermined number of sheets is placed on each of the first bin $\mathbf{210}_1$ and subsequent bins corresponding in number to the predetermined number of sheets and the sheets are thus classified and contained in the bin unit.

c) Sheet Bundle Binding Mode

A stapler (not shown) as means for binding sheet bundles classified and contained in the respective bins is provided at the position of the sheet kick-out rollers 207 for sort, and the bin unit 209 is moved down by an amount corresponding to each bin and the operation of binding the sheet bundle in the last bin up to the sheet bundle in the first bin $\mathbf{210}_1$ is sequentially effected.

SUMMARY OF THE INVENTION (1) Thus, in the sorting apparatus as the sheet post-treatment apparatus according to the prior art, the non-sort mode and the sort mode are alternative, and when the non-sort mode is selected, the bin unit 209 is held at a height position (home position) in which the uppermost first bin $\mathbf{210}_1$ as a non-sort bin corresponds to the position of the sheet kick-out rollers 205 for non-sort and therefore, the bin shifting operation cannot be permitted as long as the non-sort mode is executed. Also, the process of binding the sheet bundles classified and contained in the sort bins is executed while the bin unit 209 is shifted to the stapler position by an amount corresponding to each bin and therefore, as long as the non-sort mode is executed, the operation of shifting a unit for driving the staple as the sheet binding means and the bin unit cannot be permitted.

In view of the above, it is a first object of the present invention to provide a sheet post-treatment apparatus which can perform the operation of binding sheet bundles distributed and contained in sort bins even during the execution of the non-sort mode.

(2) The sorting apparatus as the sheet post-treatment apparatus according to the prior art, when the operation of the staple driving unit in the sorting apparatus is permitted by a manual staple key, performs the binding operation while shifting a sheet bundle discharged onto a sort bin by an amount corresponding to one bin. Consequently, when the non-sort mode from the sheet output apparatus is permitted, the bin unit of the sorting apparatus is inhibited from operating and therefore, parallel operations could not be permitted. That is, it is impossible to perform an operation mode free of influence, for example, during the operation of binding a sheet bundle, and this has led to the inconvenience of time loss.

In view of the above, it is a second object of the present invention to provide a sheet post-treatment apparatus in which it is made possible to permit an operation mode free of influence during the operation of binding a sheet bundle.

(3) In the sorting apparatus as the sheet post-treatment apparatus according to the prior art, the operation of binding sheet bundles distributed and contained in the respective bins at a predetermined number of stages during the sort mode operation, by the binding means, and the operation of feeding and piling sheets onto the first bin as a non-sort bin during the non-sort mode cannot be performed in parallel with each other, and this has led to the inconvenience of time loss.

In view of the above, it is a third object of the present invention to provide a sheet post-treatment apparatus which can perform the above-described two operations in parallel with each other.

(4) In the sorting apparatus as the sheet post-treatment apparatus according to the prior art, the bin unit when the sheet bundles distributed and contained in the sort bins at a predetermined number of stages have then been bound by the binding means is in its lowermost position and therefore, a user has to lean over when he or she takes the sheet bundles out of the respective bins, and this has led to the inconvenience of difficulty in taking out the sheet bundles.

In view of the above, it is a fourth object of the present invention to enable sheet bundles to be easily taken out of sort bins after the termination of the sorting operation or after the termination of the sheet bundle binding operation.

(5) In the sorting apparatus as the sheet post-treatment apparatus according to the prior art, the control from the sheet output apparatus has been impossible with regard to the release of needle jam caused by the thickness or the like of the sheet bundle when bound. That is, for example, the power source switch of the sorting apparatus must be opened and then be closed again as a method of releasing needle jam when it has happened, and this is very difficult.

In view of the above, it is a fifth object of the present invention to provide a sheet post-treatment apparatus which can restore a sheet output apparatus without stopping the entire system even when needle jam happens.

(i) According to the present invention, a sheet discharge tray for non-sort is a member provided independently of the sorting apparatus and independent of the moving operation of the sort bins of the sorting apparatus. Whereby, even when the non-sort operation mode is selected and sheets discharged from a sheet output apparatus are being piled on the sheet discharge tray for non-sort, it becomes possible to manually insert sheet bundles into the sort bins of the sorting apparatus, and depress a manual staple key provided on the sorting apparatus to thereby perform the operation of binding the sheet bundles. As a result, it is possible to perform the parallel processes of executing the staple operation without waiting for the termination of the non-sort operation and thus, shorten the time.

(ii) Even when the manual staple key provided on the sorting apparatus is depressed and the sheet bundles are being bound after the sort operation mode is selected and sheets are piled on the plurality of sort bins of the sorting apparatus and the last sheet has been piled, it becomes possible to continuedly permit the non-sort operation mode. As a result, it is possible to perform the parallel processes of executing the piling operation of non-sort sheets onto the sheet discharge tray for non-sort without waiting for the staple operation and thus, shorten the time.

(iii) In a state in which the sort operation mode is selected and sheets are piled on the plurality of sort bins of the sorting apparatus and the last sheet is piled, whereafter the sheet bundles in the plurality of sort bins are left unremoved, it becomes-possible to permit the parallel process mode of the operation of binding the sheet bundles and the operation of piling sheets discharged from the sheet output apparatus on the sheet discharge tray for non-sort. As a result, if the staple mode is designated from the sheet output apparatus, it will be possible to operate the sorting apparatus without operating the non-sort mode and the auto staple mode individually.

(iv) Provision is made of a sorting apparatus for classifying sheets discharged from a sheet output apparatus and containing them in a plurality of sort bins, and means for binding sheet bundles piled and contained in the sort bins in succession for each sort bin, and after the termination of discharging sheets to the sorting apparatus and before the binding means is operated, the plurality of sort bins in the sorting apparatus can return to the first bin. As a result, after the termination of sorting or after the termination of staple, the bin unit of the sorting apparatus has been moved up and therefore, it becomes easy to take the bundle sheets out of the sort bins.

(v) Provision is made of a sorting apparatus for classifying sheets discharged from a sheet output apparatus and containing them in a plurality of sort bins, means for binding sheet bundles piled and contained in the sort bins in succession for each sort bin, means for sending a needle jam signal produced in the binding means to the sheet output apparatus, and means for sending a needle jam release signal from the sheet output apparatus to the sorting apparatus, and the needle jam signal produced in the binding means can be released by said needle jam release signal. As a result, without cutting off the power source of the sheet output apparatus, a control device (needle jam flag) in the sorting apparatus can be released from the operating panel of the sheet output apparatus.

DESCRIPTION OF THE PREFERRED EMBODIMENT

Figure 1:
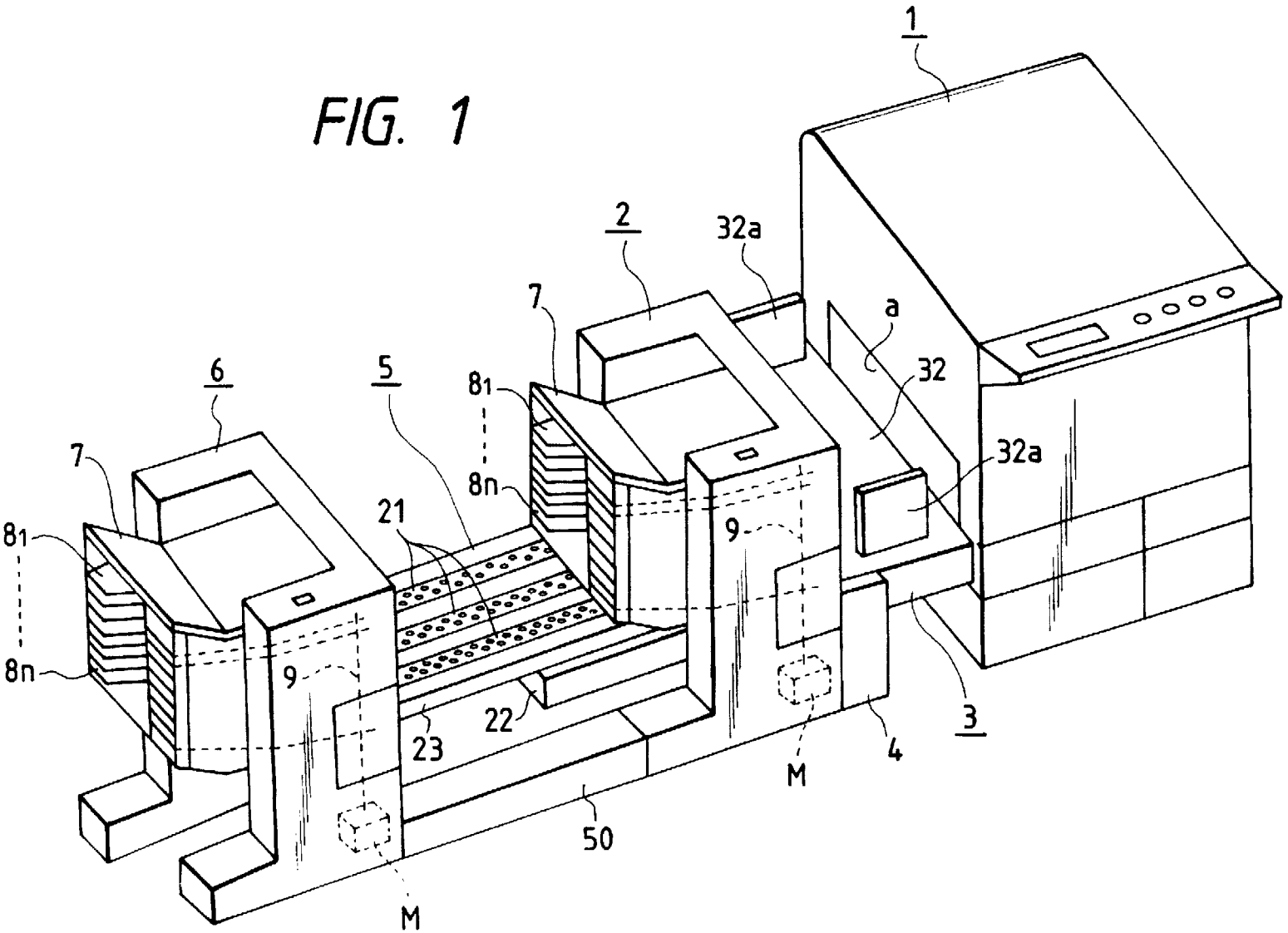
FIG. 1 is a pictorial perspective view of an image forming apparatus having a sheet post-treatment apparatus according to an embodiment of the present invention.

An embodiment of the present invention will hereinafter be described with reference to FIGS. 1 and 2. FIG. 1 is a pictorial perspective view of an embodiment of the image forming apparatus provided with the sheet post-treatment apparatus of the present invention (which is of the double sequence type using two sorting apparatuses connected together), and FIG. 2 is a view schematically showing the construction thereof.

The reference numeral 1 designates a sheet output apparatus, and the reference numeral 2 denotes a first sequence sorting apparatus (hereinafter referred to as the "sorter") connected to the sheet outlet a side of the sheet output apparatus 1. The reference numeral 6 designates a second sequence sorter connected next to the first sequence sorter 2. The first and second sequence sorters 2 and 6 are series-connected together by a removably mounted connecting member 50 with a predetermined spacing interposed therebetween. The reference numeral 3 denotes a first intermediate conveying unit for bridging the sheet outlet a of the sheet output apparatus 1 to the first sequence sorter 2, and the reference numeral 5 designates a second intermediate conveying unit for bridging the first and second sorters 2 and 6 together.

Figure 2:
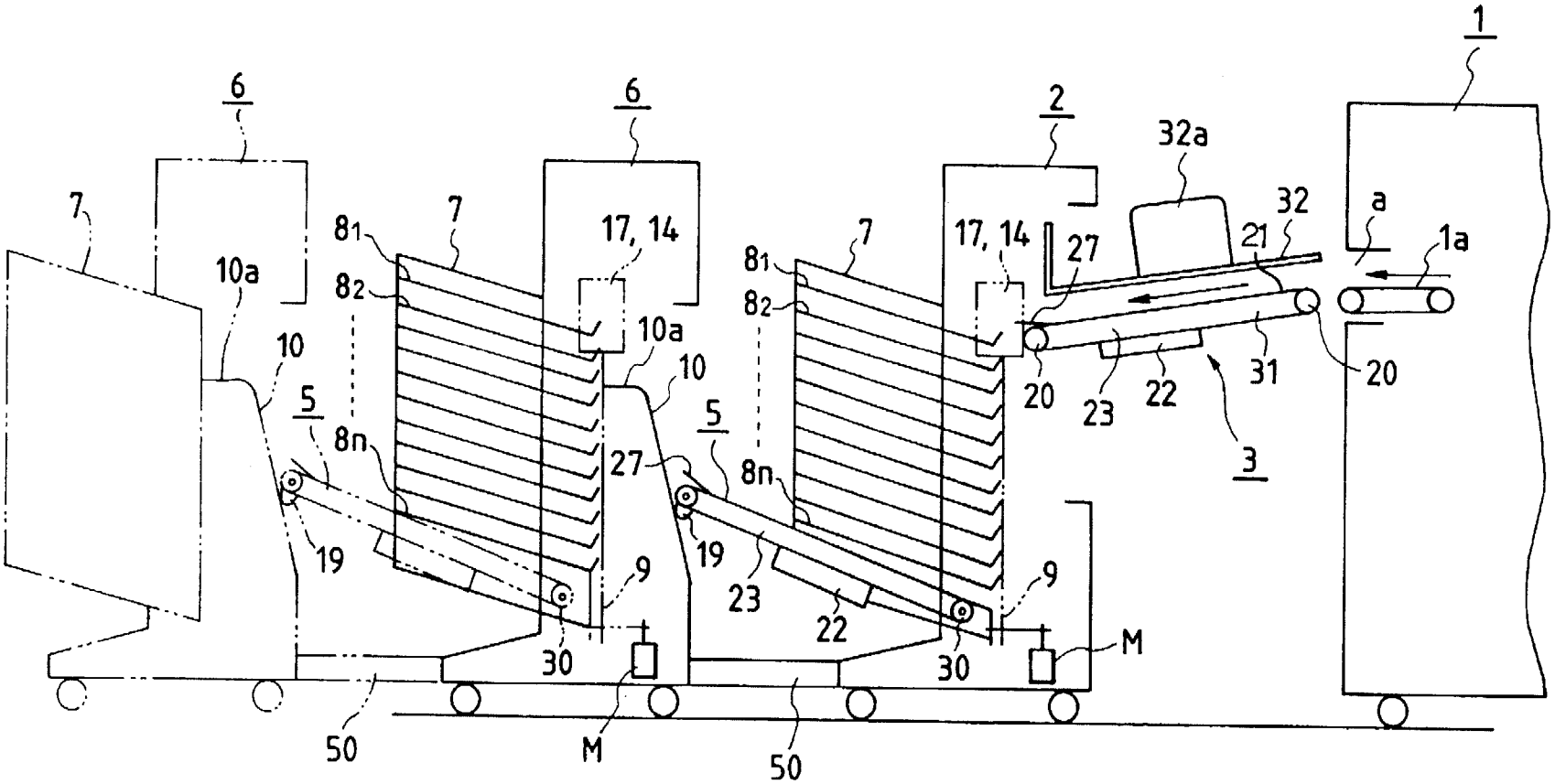
FIG. 2 is a view schematically showing the construction of the apparatus of FIG. 1.

This sheet post-treatment apparatus comprises the two sorters 2 and 6 connected together, but third and subsequent sequence sorters similar to the second sequence sorter may be coupled in series to the second sorter by connecting members 50 as indicated by dots-and-dash lines in FIG. 2 to thereby increase the number of sorters.

Main constituents will hereinafter be successively described.

(1) Sheet Output Apparatus 1

The sheet output apparatus 1 herein is a press printing apparatus, but may be any one of a printing machine, a copying machine, a collator, etc. Briefly describing, in the interior of the apparatus 1, there are an impression drum supported by a shaft serving also as an ink supply pipe, having a perforated master wound around the outer peripheral surface thereof, and rotatively driven in a clockwise direction, a press roller for pressing a sheet (printing paper) conveyed by a paper supply device against the outer peripheral surface of the impression drum to thereby effect printings and a peeling pawl for peeling the sheet from the outer peripheral surface of the impression drum (all being not shown), and the printed sheet is discharged out of the apparatus through the sheet outlet a by discharge means 1*a*.

(2) First Sequence Sorter 2

The first sequence sorter 2 is an apparatus of the bin unit moving type having a number of sort bins. The reference numeral 7 designates a bin unit having a plurality of sort bins $8_1$ to $8_n$ disposed in vertically multiple stages therein and made vertically movable relative to the sorter body. The bin unit 7 is moved up and down relative to the sorter body by an ascend/descend drive portion 9 including a motor M, a lead cam 17, etc. A stapler unit 14 as sheet bundle binding means is disposed at a level corresponding to the position of the uppermost first bin $8_1$ of the bin unit 7 in its home position in which it has been lowered to a predetermined descent position.

The first sequence sorter 2 is provided with a first intermediate conveying unit 3 for bridging the sheet outlet a of the sheet output apparatus 1 to the first sequence sorter 2, and a second intermediate conveying unit 5 for bridging the first and second sequence sorters 2 and 6 together.

(3) Second Sequence Sorter 6

The second sequence sorter 6, like the above-described first sequence sorter 2, is an apparatus of the bin unit moving type, and has a plurality of sort bins $8_1$ to $8_n$ disposed in vertically multiple stages, a bin unit 7 vertically movable relative to the sorter body, a bin unit ascend/descend drive portion 9 including a motor M, a lead cam 17, etc., a stapler unit 14, etc. A forwardly inclined (inclined inwardly of the apparatus body) slope portion 10 is provided on the rear surface plate of the body of the second sequence sorter 6.

Figure 3B:
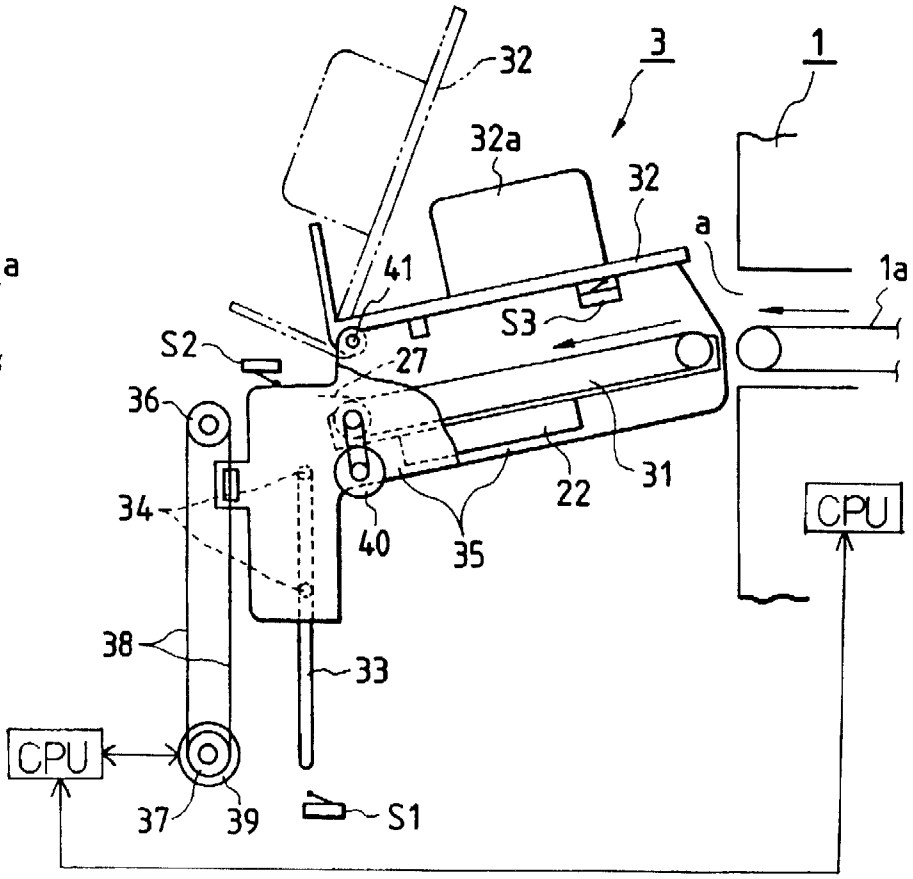
FIGS. 3A and 3B are schematic views showing the construction of a first intermediate conveying unit and showing the position changeover states during the nonsort mode and the sort mode, respectively.
Figure 3A:
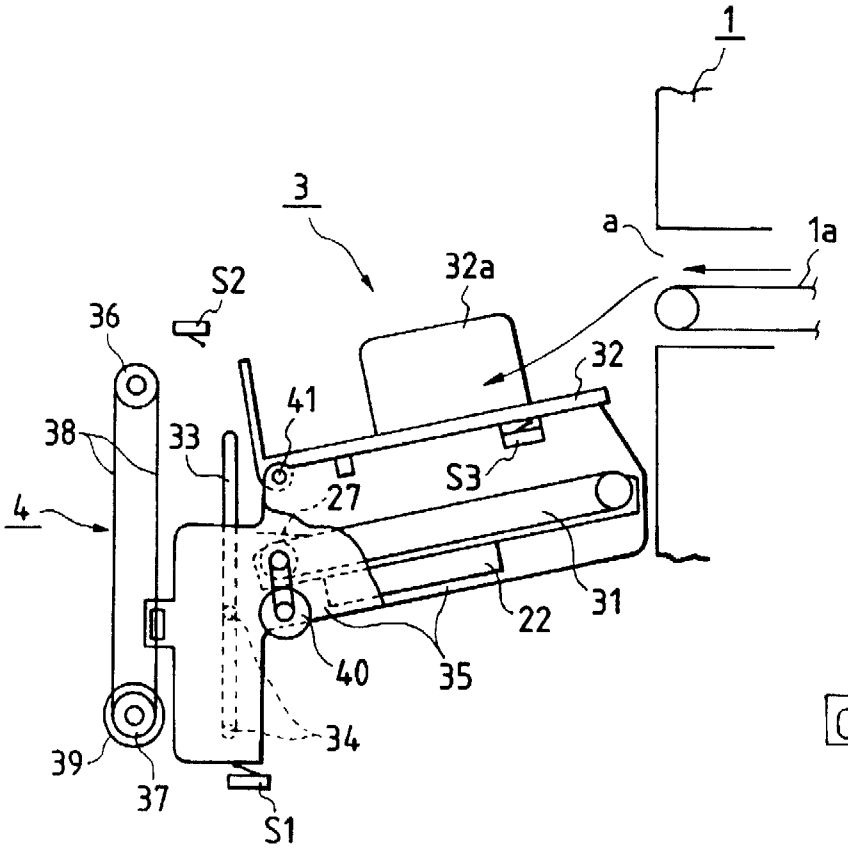

(4) First Intermediate Conveying Unit 3 (FIGS. 3A and 3B)

As shown in FIGS. 3A and 3B, the first intermediate conveying unit 3 for bridging the sheet output apparatus 1 and the first sequence sorter 2 together is provided on the first sequence sorter 2 side, and is provided with an intermediate conveying portion 31 of the belt conveyance type as connection means for the sheet output apparatus 1 and the first sequence sorter 2 which is driven by a motor 40, and a sheet discharge tray 32 for non-sort located above it.

The first intermediate conveying unit 3 is changed over and moved to a first changeover position as shown in FIG. 3A wherein it is moved down to a predetermined position relative to the sheet output apparatus 1 by an ascend/descend mechanism 4 and a sheet discharge tray 32 for non-sort receives sheets outputted from the sheet output apparatus 1 correspondingly to the sheet outlet a of the sheet output apparatus 1, and a second changeover position as shown in FIG. 3B wherein it is moved up to a predetermined position and the intermediate conveying portion 31 takes over the sheets outputted from the sheet output apparatus 1 correspondingly to the sheet outlet a of the sheet output apparatus.

The intermediate conveying portion 31 and the sheet discharge tray 32 for non-sort are disposed in a frame 35 vertically movable relative to the body of the sorter 2 by a vertically elongate guide slot 33 and a guide pin 34 formed on the main body of the sorter 2, and the frame 35 is connected to a chain 38 wound between upper and lower sprockets 36 and 37 and is vertically moved with the forward and reverse rotations of the chain 38 caused by the lower sprocket 36 being forwardly and reversely driven by a forwardly and reversely rotatable motor 39.

The intermediate conveying unit 3 descends to a descent terminal regulated by the lower end of the vertically elongate guide slot 33 and the guide pin 34 by the motor 39 being forwardly rotated, and when the descent thereof is detected by a first sensor (non-sort position sensor) Si, the forward rotation of the motor 39 is stopped and locked, and the intermediate conveying unit 3 is held in the aforedescribed first changeover position of FIG. 3A. On the other hand, by the motor 39 being reversely rotated, the intermediate conveying unit 3 ascends to an ascend terminal regulated by the upper end of the vertically elongate guide slot 33 and the guide pin 34, and when the ascent thereof is detected by a second sensor (sort position sensor) S2, the reverse rotation of the motor 39 is stopped and locked, and the intermediate conveying unit 3 is held in the aforedescribed second changeover position of FIG. 3B.

The sheet discharge tray 32 for non-sort can be opened and pivotally moved about a hinge shaft 41 relative to the frame 35 as indicated by dots-and-dash lines in FIG. 3B, whereby the work of removing any jammed sheet in the intermediate conveying portion 31 can be done easily. When the tray 32 is opened and pivotally moved, a third sensor S2 is turned off, whereby it is detected that the tray 32 has been opened and pivotally moved. The reference character 32*a* designates a side guide provided on the sheet discharge tray 32 for non-sort.

The ascent and descent of the first intermediate conveying unit 3 to the first and second changeover positions are controlled by serial communication from the control device (CPU) of the sheet output apparatus 1 to the CPU of the sorter.

Figure 4:
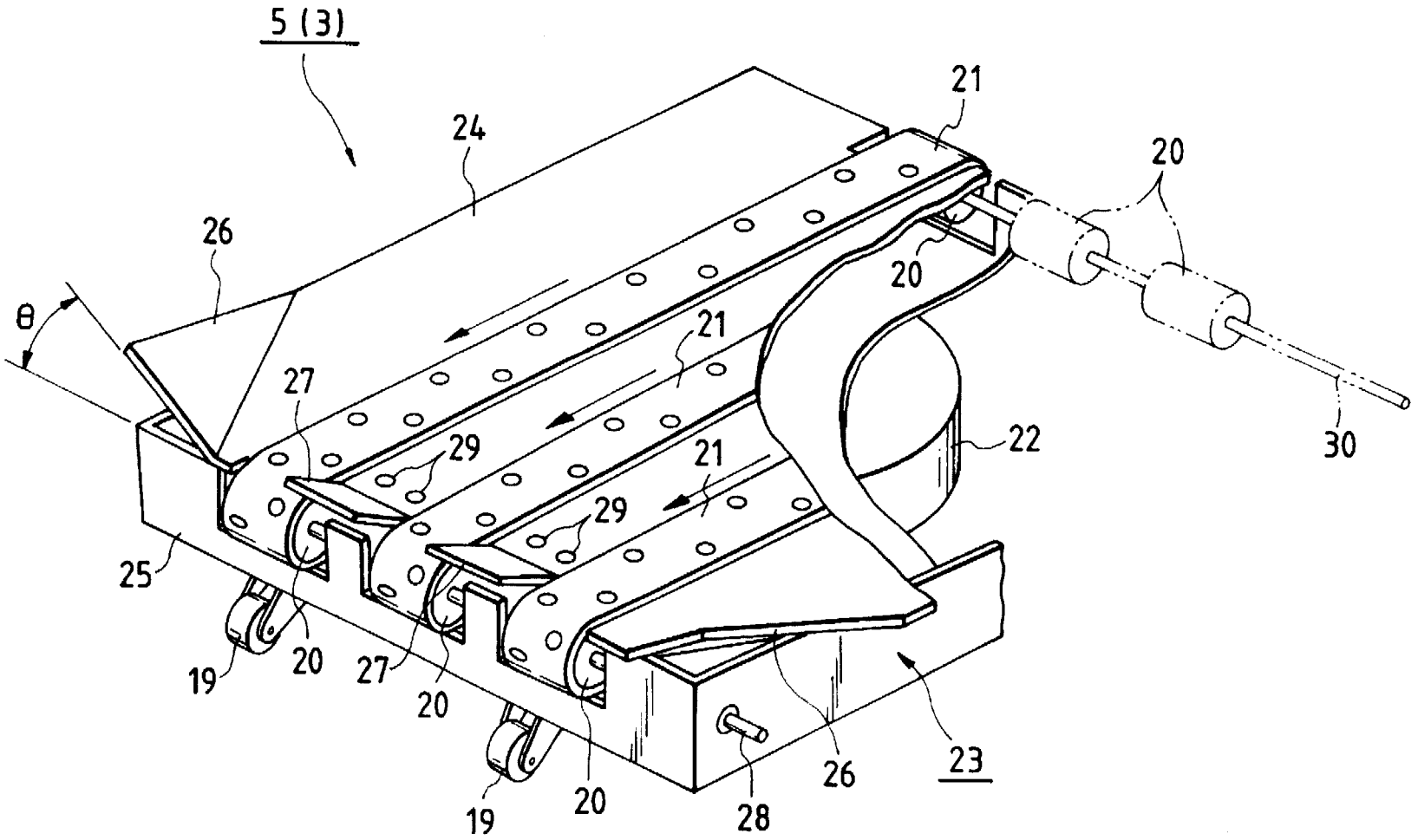
FIG. 4 is a partly cut-away perspective view of a second intermediate conveying unit.

(5) Second Intermediate Conveying Unit 5 (FIG. 4)

As shown in FIG. 4, the second intermediate conveying unit 5 for bridging the first and second sequence sorters 2 and 6 together has its upstream end portion with respect to the direction of sheet conveyance supported for pivotal movement about a shaft 30 below the lowermost sort bin $8_n$ relative to the unit frame of the bin unit 7 of the first sequence sorter 2. Also, a guide roller 19 is provided on the downstream end portion of the second intermediate conveying unit 5 with respect to the direction of sheet conveyance, and the guide roller 19 is received by the aforementioned forwardly inclined slope portion 10 provided on the rear surface plate of the sorter body of the second sequence sorter 6. Accordingly, the second intermediate conveying unit 5 has its weight supported divisionally by the bin unit 7 of the first sequence sorter 2 and the slope portion 10 of the second sequence sorter 6.

This second intermediate conveying unit 5 is comprised of a conveying portion body 23, plural rollers 20 disposed at the upstream and downstream sides of the conveying portion body 23 with respect to the direction of sheet conveyance, a plurality of endless belts 21 extended between the rollers at said upstream and downstream sides and each having a plurality of openings in the surface thereof, a suction fan 22 disposed in the lower portion of the conveying portion body 23, etc.

The conveying portion body 23 is integrally comprised of a flat box type housing 25 and a top plate 24. The shafts 28 and 30 of the rollers 20 are rotatably supported on the conveying portion body 23, and their shape is a crown shape, and the endless belts 21 always keep the same position. The drive force of a motor-(not shown) is transmitted to the ends of the shafts through a timing belt (not shown), whereby the endless belts 21 are rotatively driven in the direction of sheet conveyance.

A first jump bed 26 and a second jump bed 27 provided by the top plate 24 of the conveying portion body 23 being upwardly bent are formed in the downstream end portion of the top plate 24 with respect to the direction of sheet conveyance. The first jump bed 26 is for giving sheets (particularly of a large size) rigidity in a direction horizontal relative to the direction of conveyance and discharging the sheets smoothly in the sort bins 8, and it has been found from an experiment that the angle θ with respect to the horizontal plane may desirably be 5 to 15 degrees. On the other hand, the second jump bed 27 is bent in a direction perpendicular to the direction of conveyance relative to printing sheets and is for substantially adjusting the printing sheet discharge angle to the sort bins 8 to thereby prevent the rubbing between the printing sheets.

A plurality of suction ports 29 are disposed near the second jump bed 27 of the top plate 24 so as to strongly adsorb the printing sheets to the endless belts 21 and enhance the kick-out force when the printing sheets are discharged into the sort bins 8. The guide rollers 19, as previously described, are provided on the downstream end portion of the second intermediate conveying unit 5 with respect to the direction of sheet conveyance and bear against the slope portion 10 of the second sequence sorter body 7.

The second intermediate conveying unit 5 is rotatably supported about the shaft 30 below the lowermost sort bin $8_n$ relative to the unit frame of the bin unit 7 of the first sequence sorter 2, and is removably mounted on the shaft 30. When the second sequence sorter 6 is absent, this unit 5 is unnecessary and is therefore not mounted.

Also, when third and subsequent sequence sorters similar to the second sequence sorter 6 are successively coupled in series to the second sequence sorter 6 by connecting members 50 to thereby increase the number of sorters, means similar to the case of the second sequence sorter 6 is adopted for the unit frame of the bin unit 7 of each added sorter except the last sorter. That is, below the lowermost sort bin $8_n$, the second intermediate conveying unit is supported and mounted for pivotal movement about the shaft 30 and the guide rollers 19 on the downstream end portion with respect to the direction of sheet conveyance are supported by the slope portion 10 of the rear surface plate of the next-stage sorter body, and the respective sorters to be connected together are connected together.

The aforedescribed first intermediate conveying unit 3 which connects the first sequence sorter 2 and the sheet output apparatus 1 together is also similar in structure conveying unit 5 (but does not have the guide rollers 19).

(6) Stapler Unit 14

Figure 5A:
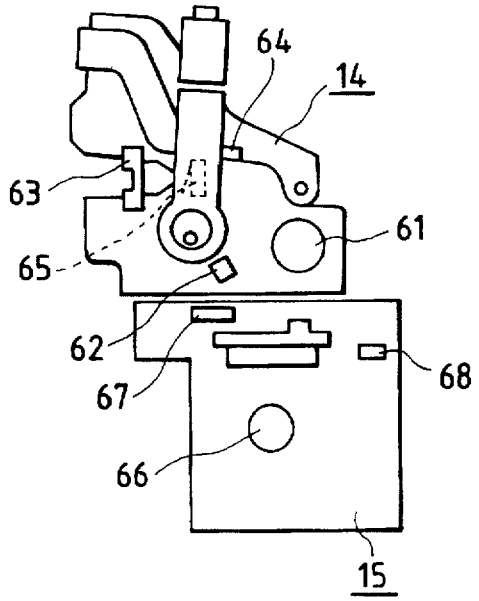
FIG. 5A is a side view of a stapler unit.
Figure 5B:
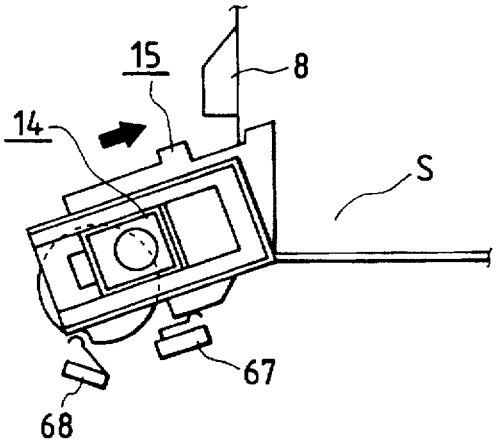
FIGS. 5B and 5C are plan views of a stapler rocking unit during its rocking movement.
Figure 5C:
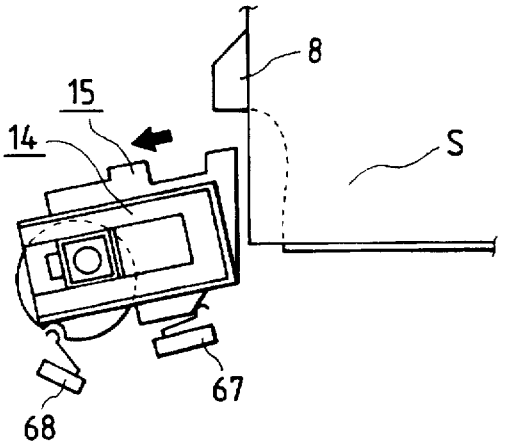

(FIGS. 5A to 5C)

FIG. 5A is a side view of the stapler unit 14, and FIGS. 5B and 5C are plan views of the stapler rocking unit during its rocking movement.

The stapler unit driving system is comprised of the stapler unit 14 and the stapler rocking unit 15. The stapler unit 14 comprises a staple motor 61 and a staple operation home position sensor 62. The staple motor 61 is controlled by a driving signal from the CPU of the sorter, and as regards the staple operation home position sensor 62, a state in which a sensor is ON is the home position, and the staple operation is performed while a cam (not shown) makes one full rotation. Also, the presence or absence of paper (sheet) is checked up by a staple position paper sensor 63, and a no-needle sensor 64 checks up the presence or absence of a needle, when foreign matters come into the staple position in a bin. When the staple unit 14 is in the staple position, the rocking sensor 68 is OFF and a stapler position set sensor 67 is ON. An actuator (not shown) is raised and a safety switch 65 is opened.

(7) Operation (FIGS. 2, 6 to 8)

The first and second sequence sorters 2 and 6 are such that an electrical control portion (CPU) on the sorter side and a control portion (CPU) on the sheet output apparatus (press printing apparatus) 1 side are electrically connected together through an electric circuit.

(i) During the Non-sort Mode

When this mode is selected, the first intermediate conveying unit 3 for bridging the-sheet output apparatus 1 and the first sequence sorter 2 together is changed over to and held in the first changeover position. That is, as shown in FIG. 3A, the sheet discharge tray 32 for non-sort in the first intermediate conveying unit 3 is held in its lowered position for receiving the sheets outputted from the sheet output apparatus 1 correspondingly to the sheet outlet a of the sheet output apparatus 1. The belt driving of the intermediate conveying portion 31 and the driving of the suction fan 22 are not done. In this state, the sheets successively outputted from the sheet output apparatus 1 are all successively kicked out and piled on the sheet discharge tray 32 for non-sort in the first intermediate conveying unit 3.

(ii) During the Sort Mode

When this mode is selected, the first intermediate conveying unit 3 is changed over to and held in the second changeover position. That is, as shown in FIGS. 2 and 3B, the intermediate conveying portion 31 of the first intermediate conveying unit 3 is held in its elevated position for taking over the sheets outputted from the sheet output apparatus 1. Then, the belts 21 of the intermediate conveying portion 31 become driven and the suction fan 22 becomes driven.

1) In the present embodiment, it is to be understood that when printing is started, the sort mode using the first and second sequence sorters 2 and 6 is selected on the operating board (not shown) of the sheet output apparatus 1 (there is also a sort mode using the first sequence sorter 2 alone). The bin units 7 of the first and second sequence sorters 2 and 6 are both initially set to a state in which they have been lowered to the predetermined lowermost home position relative to the sorter body, as shown in FIG. 2.

In this state, the bin unit 7 of the first sequence sorter 2 stands by in a state as shown in FIG. 2 wherein the sort bin $8_1$ in the first stage (the uppermost stage) corresponds to the downstream end portion (hereinafter referred to as the "sheet kick-out portion") of the intermediate conveying portion 31 of the first intermediate conveying unit 3 with respect to the direction of sheet conveyance. The second intermediate conveying unit 5 descends with the bin unit 7 of the first sequence sorter 2 when the latter descends to its home position, and the guide rollers 19 on the downstream end portion (hereinafter referred to as the "sheet kick-out portion") of the second intermediate conveying unit with respect to the direction of sheet conveyance are lowered and supported below the slope portion 10 of the second sequence sorter-6 and are in substantially the same inclined posture as the sort bins $8_1$ to $8_n$ of the bin unit 7 of the first sequence sorter 2.

2) When printing is started in the sheet output apparatus 1, a printed sheet discharged out of the apparatus by the discharge means la through the sheet outlet a rides onto the intermediate conveying portion 31 of the first intermediate conveying unit 3 and is conveyed to the first sequence sorter 2 while being sucked onto the endless belts 21 by the suction fan 22. Thereafter the sheet is conveyed into the sort bin $8_1$ along the angle of the sort bin $8_1$ in the first stage of the bin unit 7 of the sorter 2 while being rigidified by the first and second jump beds 26 and 27 of the sheet kick-out portion.

The bin unit 7 of first sequence sorter 2 is upwardly driven by an amount corresponding to each one stage of the sort bins by the operation of the ascend/descend unit including the motor M, the lead cam 17, etc. in synchronism with the printing by the sheet output apparatus 1 and also, at the position of the sheet kick-out portion of the intermediate conveying portion 31 of the first intermediate conveying unit 3, the frontage between predetermined adjacent bins is opened, thus becoming ready to receive the sheet. When the feeding of the sheet into the sort bin $8_1$ in the first stage is terminated, the bin unit 7 is moved up by an amount corresponding to one stage of the bin, and at the position of the sheet kick-out portion of the intermediate conveying portion 31 of the first intermediate conveying unit 3, the frontage between the sort bins $8_1$ and $8_2$ in the first and second stages is opened and thus, the next sheet is fed into the sort bin $8_2$ in the second stage.

Figure 6:
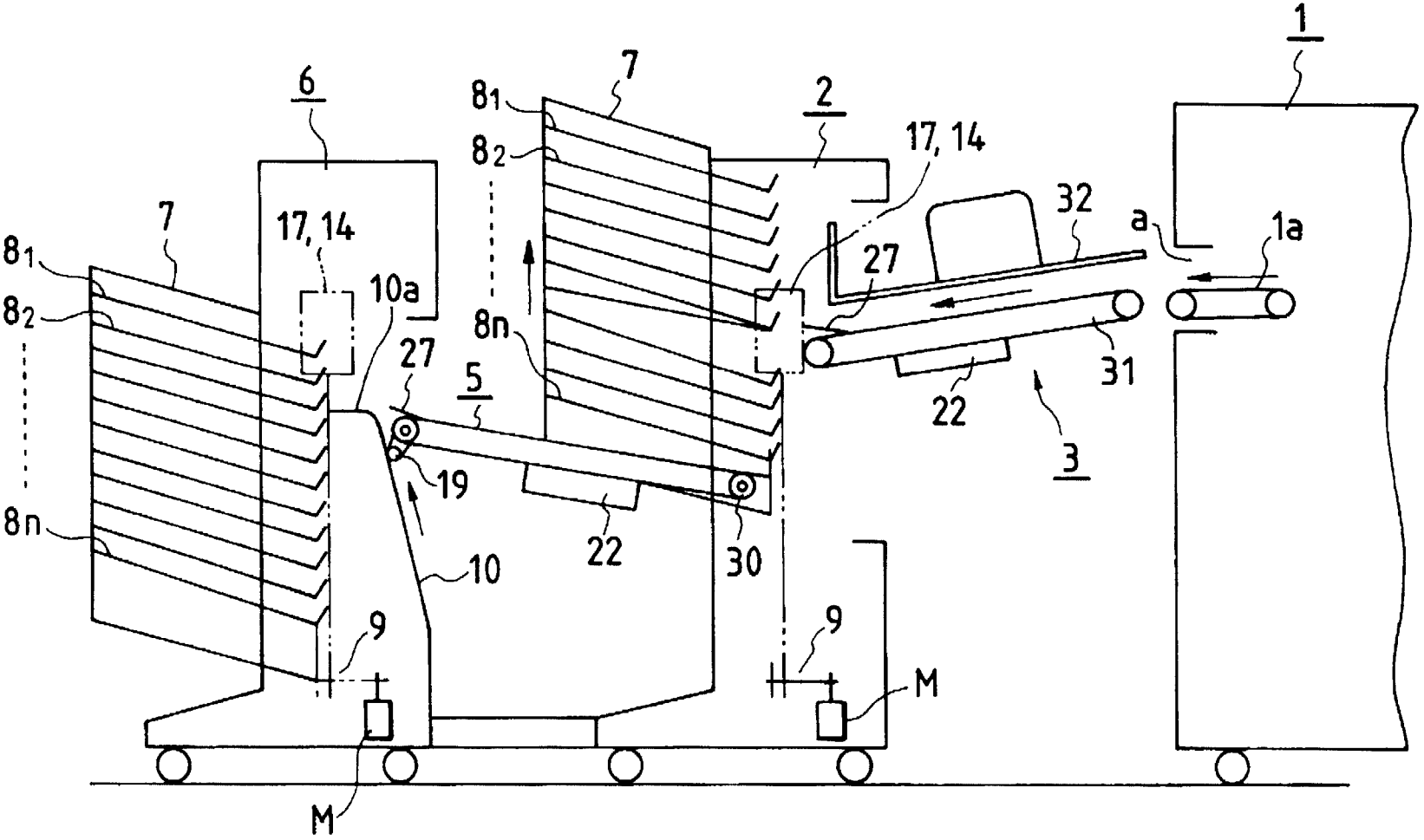
FIG. 6 shows the state during the sheet feeding of a first sequence sorter into a sort bin at an intermediate state in a bin unit.

The ascending operation of such a bin unit 7 by each one bin stage and the opening operation between adjacent bins are successively executed, whereby the feeding of the sheets into the sort bins $8_1$ to $8_n$ of the bin unit 7 is done sequentially. FIG. 6.shows the state during the feeding of sheets into the sort bins in intermediate stages.

Figure 7:
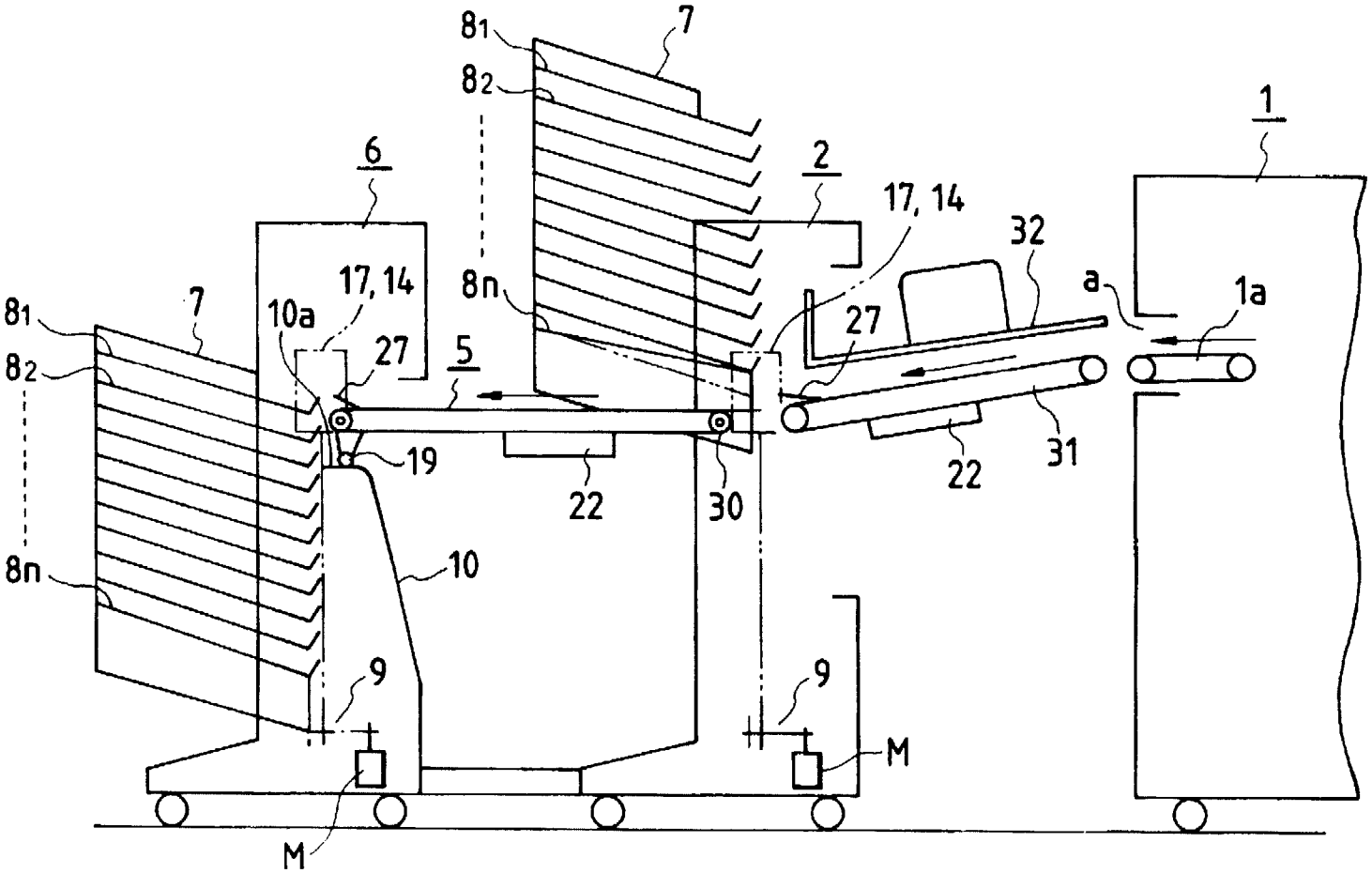
FIG. 7 shows the state when the bin unit of the first sequence sorter has been moved up to the uppermost position.

3) When the feeding of a sheet into the lowermost sort bin $8_n$ is terminated, the bin unit 7 is further moved up to its uppermost position as shown in FIG. 7 wherein the upstream end portion of the second intermediate conveying unit 5 with respect to the direction of sheet conveyance corresponds to the position of the sheet kick-out portion of the intermediate conveying portion 31 of the first intermediate conveying unit 3.

Also, the sheet kick-out portion of the second intermediate conveying unit 5 ascends along the slope portion 10 of the second sequence sorter 6 against which the guide rollers 19 on said sheet kick-out portion side as the bin unit 7 is moved up, and when the bin unit 7 is moved to its uppermost position, said sheet kick-out portion ascends completely along the slope portion 10 and arrives at a horizontal portion 10*a* on the top of the slope portion 10. Thus, the second intermediate conveying unit 5 assumes a substantially horizontal posture between the first and second sequence sorters 2 and 6 and comes to bridge the two sorters 2 and 6 together, and the weight of the second intermediate conveying unit 5 is completely divided into two, i.e., the first and second sequence sorters.

Also, in this state, the sheet kick-out portion of the second intermediate conveying unit 5 comes to correspond to the uppermost first sort bin $8_1$ of the bin unit 7 which has been lowered to its predetermined lowermost home position in the second sequence sorter 6.

4) Thereafter, the second intermediate conveying unit 5 is driven and a sheet outputted from the sheet output device 1 is conveyed from the intermediate conveying portion 31 of the first intermediated conveying unit 3 to the first sequence sorter 2, passes through the first sequence sorter 2 without stopping, rides onto the second intermediate conveying unit 5, is conveyed to the second sequence sorter 6 thereof and is fed into the first sort bin $8_1$ of the bin unit 7 thereof.

Figure 8:
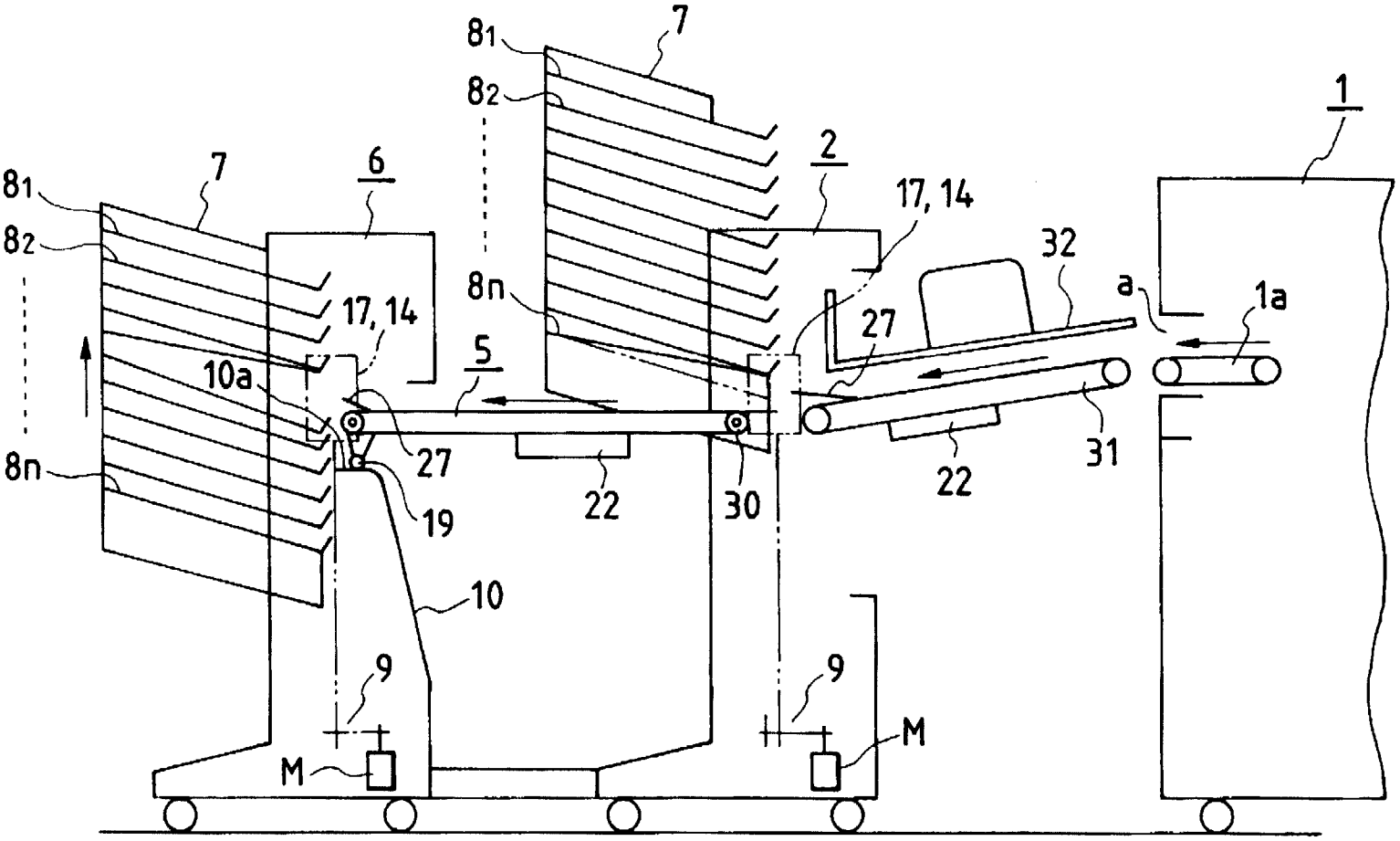
FIG. 8 shows the state during the sheet feeding into the last sort bin corresponding to a predetermined number of sheets in the bin unit of a second sequence sorter.

5) Thereof, as in the case of the first sequence sorter 2, the ascending operation of the bin unit 7 by each one stage of sort bin and the opening operation between adjacent sort bins are successively executed in the second sequence sorter 6, whereby the feeding of sheets to a sort bin in the stage corresponding to a predetermined number of sheets, as shown in FIG. 8.

6) The feeding of a sheet of the second page into each bin is effected by the bin unit 7 of the first sequence sorter 2 and the bin unit 7 of the second sequence sorter 6 being lowered from-the state of FIG. 8 to the predetermined lowermost home position as shown in FIG. 2, thus being returned to their initial state. The second intermediate conveying unit 5 descends with the descent of the bin unit 7 of the first sequence sorter 2 and the guide rollers 19 on the sheet kick-out portion thereof descend along the slope portion 10, and when the bin unit 7 descends to the first home position (FIG. 2), the guide rollers 19 also descend and return to the first lower position of the slope portion 10.

Then, the classification and reception of the second sheet are again effected from the first stage sort bin $8_1$ of the bin unit 7 of the first sequence sorter 2.

7) The operation cycle described in above items 2) to 6) above is repetitively executed a predetermined number of times, whereby a predetermined number of sheets are piled, classified and contained in the sort bins of the first and second sequence sorters 2 and 6 corresponding in number to the predetermined number of (one) sheets.

The sheets fed into the sort bins 8 of the bin unit 7 of the first sequence sorter 2 are rigidified by the first jump bed 26 and second jump bed 27 of the sheet kick-out portion of the intermediate conveying portion 31 of the first intermediate conveying unit 3, whereby they are neatly piled on the sort bins 8. Also, the sheets fed into the sort bins 8 of the bin unit 7 of the second sequence sorter 6 are rigidified by the first jump bed 26 and second jump bed 27 of the sheet kick-out portion of the second intermediate conveying unit 5, whereby they are neatly piled on the sort bins 8.

In the present embodiment, the sheet output apparatus 1 is a printing apparatus and therefore, after-one sheet distributing operation has been terminated to the sort bins of the respective sorters 2 and 6 corresponding to a predetermined number of stages and before the next sheet distributing operation is started, the operation of once lowering back to the bin units 7 of the respective sorters 2 and 6 to the home position is performed (from FIG. 8 to FIG. 2). Thereby, the time for drying the ink on the printed sheets distributed onto the sort bins is earned to thereby prevent the rubbing of print caused by the frictional contact with the next distributed sheet.

If the sheet output apparatus 1 is a copying, apparatus or the like which does not require such disposal, when one sheet distributing operation is terminated to the sort bins of the respective sorters 2 and 6 corresponding to a predetermined number of stages, the bin unit 7 of the second sequence sorter 6 may be sequentially lowered by an amount corresponding to each one stage of sort bin, whereby the next sheet distributing operation may be started from the last sort bin, and the sheet distributing operation sequence to the sort bins of the sorters 2 and 6 can be set arbitrarily.

(iii) During the Sheet Bundle Binding Mode (Staple Treatment Mode)

When this mode is selected, the last sheet to the last bin is fed as shown in FIG. 8, whereafter the bin unit 7 of the first sequence sorter 2 and the bin unit 7 of the second sequence sorter 6 are lowered from the state of FIG. 8 to the lowermost home position shown in FIG. 2, and are returned to their initial state and operated.

Then, in the first and second sequence sorters 2 and 6, the respective bin units 7 thereof are upwardly shifted by an amount corresponding to each one stage of bin and the stapler unit 14 is operated, whereby the binding process is executed sequentially from the sheet bundles contained in the first stage bins of the bin units 7 of the first and second sequence sorters 2 and 6. When the binding of the sheet bundles in all bins into which the sheets are distributed is thus terminated, the bin units 7 of the first and second sequence sorters 2 and 6 are stopped at their elevated position as shown in FIG. 8. Thus, the operator can easily take the bound sheet bundles out of the respective bins without stopping.

Also in the case of a sort mode in which the sheet bundle binding process is not effected, when the sorting operation is terminated, the bin units 7 of the first and second sequence sorters 2 and 6 are stopped at their elevated position as shown in FIG. 8, whereby the operator can easily take the sorted sheet bundles out of the respective bins without stopping.

After the sheet bundles are taken out of all bins into which the sheets have been distributed, the bin unit 7 of the first sequence sorter 2 and the bin unit 7 of the second sequence sorter 6 are respectively lowered from the state of FIG. 8 to the predetermined lowermost home position as shown in FIG. 2 and are returned to their initial state and operated.

Figure 9:
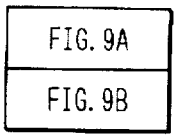
FIG. 9 is comprised of FIGS. 9A and 9B showing block diagrams illustrating the circuit construction of the control device of the first sequence sorter.
Figure 9A:
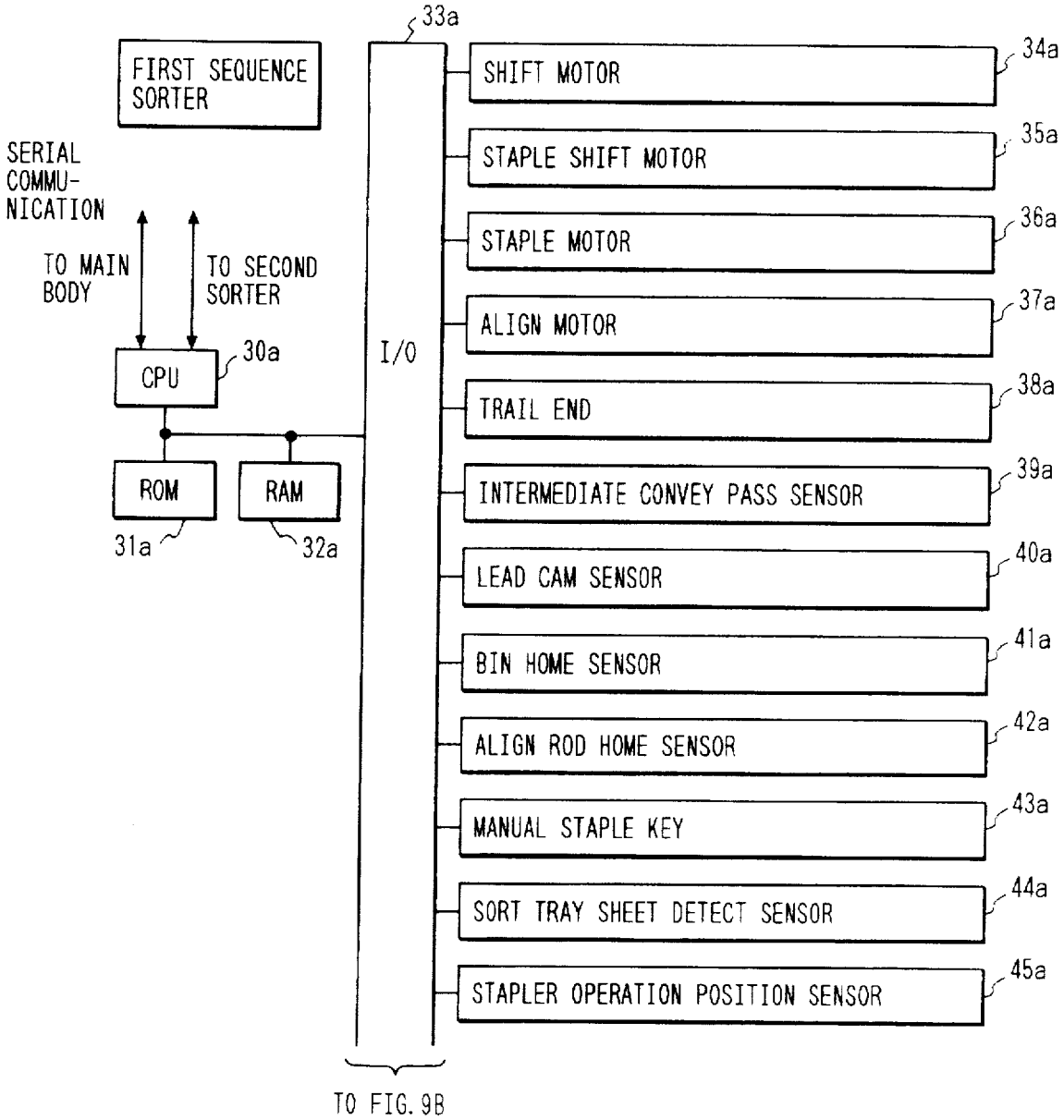
Figure 9B:
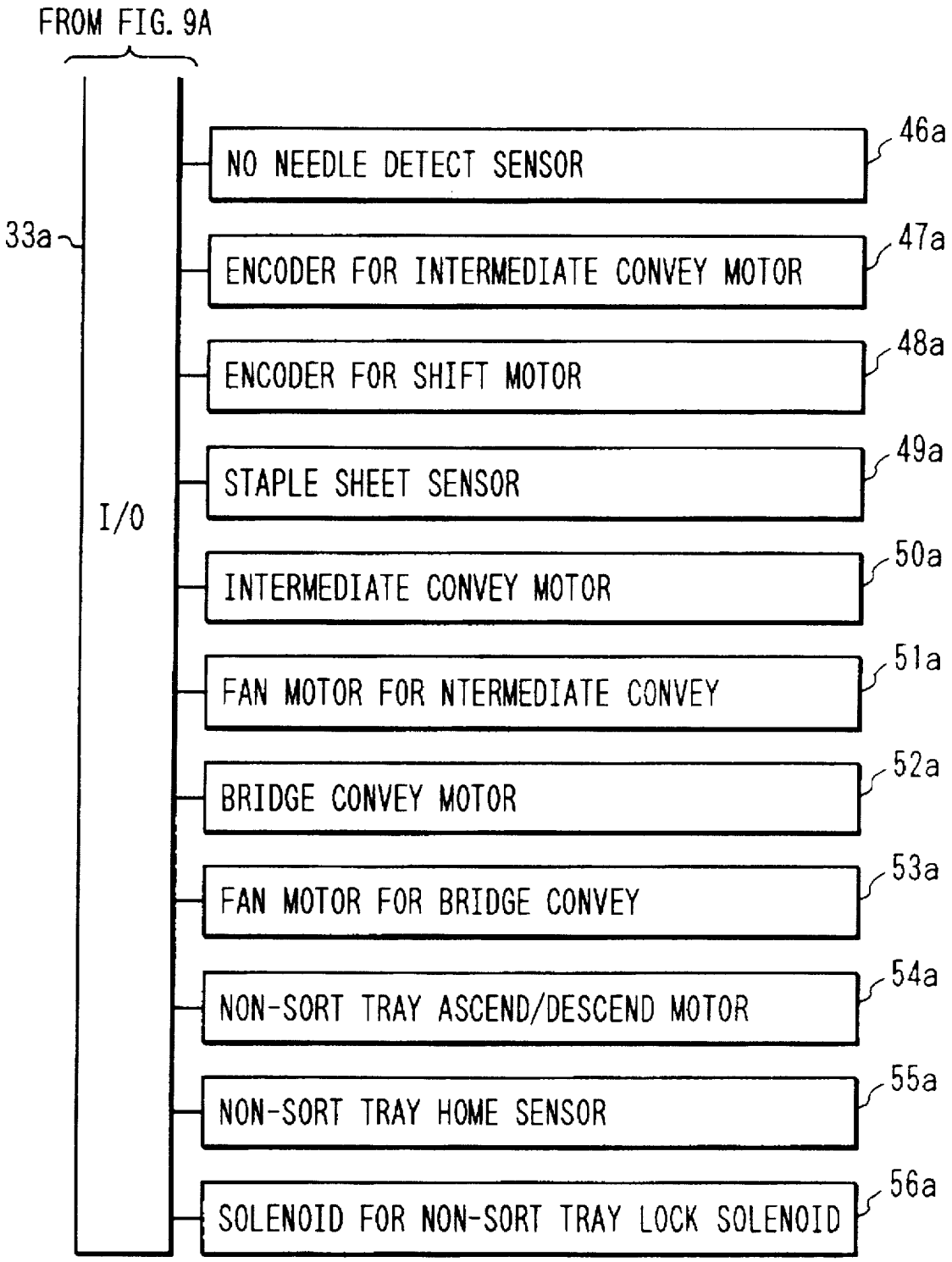

(8) Control Device of the First Sequence Sorter 2 (FIGS. 9A and 9B)

In FIGS. 9A and 9B which are block diagrams showing the circuit construction of the control device of the first sequence sorter 2, the first sequence sorter 2 is provided with a control device comprising a central processing unit CPU 30*a*, a read only memory ROM 31*a*, a random access memory RAM 32*a*, an input-output port 33*a*, etc., a control program is stored in the ROM 31*a*, and input data and data for operation are stored in the RAM 32*a*.

Various motors including a shift motor 34*a* (M) and solenoid driving means are connected to the-output port of the input-output port 33*a*, and sensors 40*a* to 49*a* including an intermediate convey pass sensor 39*a* and a switch are connected to the input port of the input-output port 33*a*, and the CPU 30*a* controls each portion connected thereto through a pass in accordance with the control program stored in the ROM 31*a*. Also, the CPU 30*a* has a serial interface function and effects serial communication with the CPU of the sheet output apparatus body and controls each portion by a signal from the sheet output apparatus body.

Figure 10:
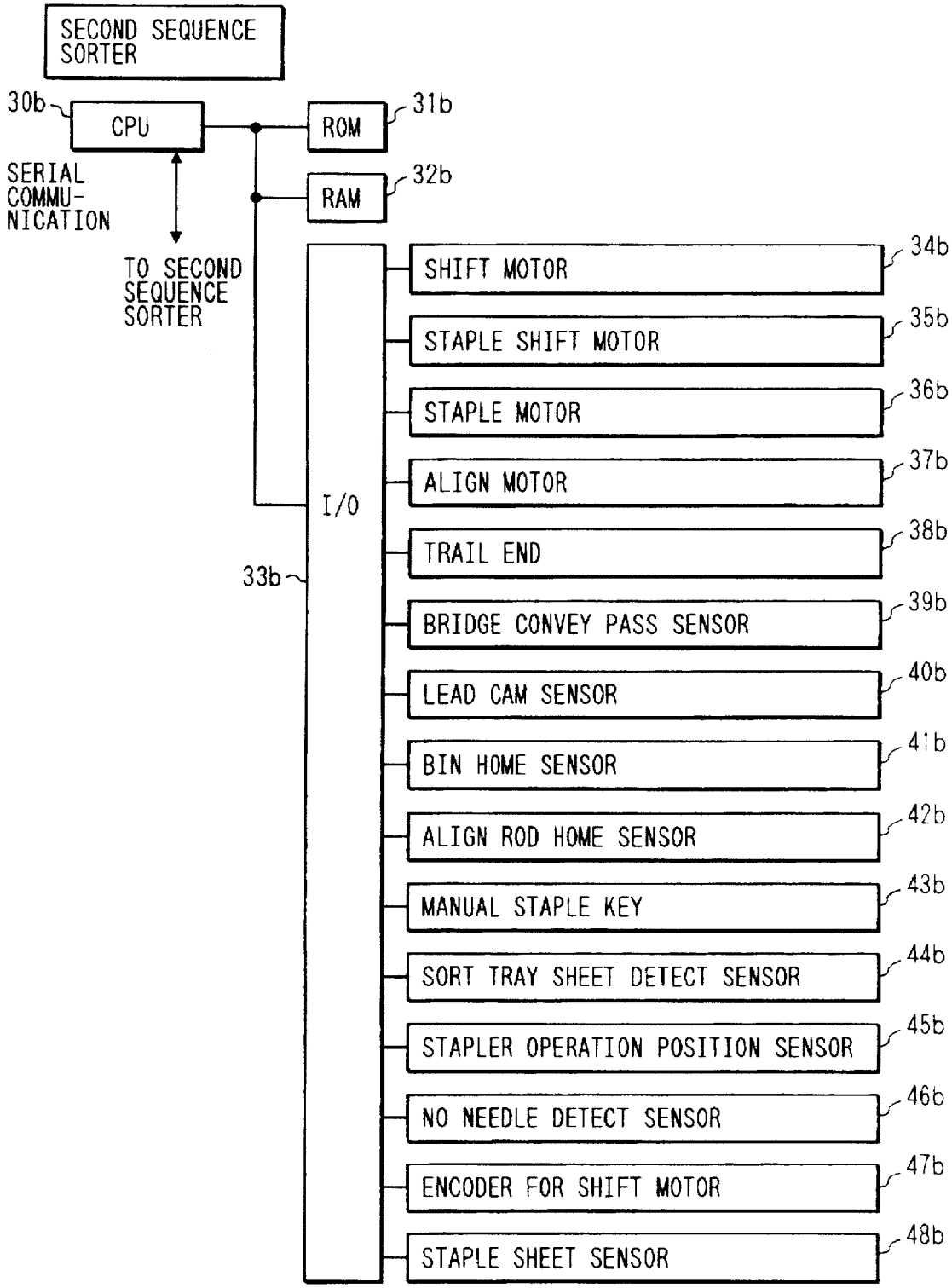
FIG. 10 is a block diagram showing the circuit construction of the control device of the second sequence sorter.

(9) Control Device of the Second Sequence Sorter 6 (FIG. 10)

In FIG. 10 which is a block diagram showing the circuit construction of the control device of the second sequence sorter 6, the control device comprises a central processing unit CPU 30*b*, a read only memory ROM 31*b*, a random access memory RAM 32*b*, an input-output port 33*b*, etc., a control program is stored in the ROM 31*b*, and input data and data for operation are stored in the RAM 32*b*.

Various motors including a shift motor 34*b* (M) and solenoid driving means are connected to the output port of the input-output port 33*b*, and sensors 40*b* to 48*b* including an intermediate convey pass sensor 39*b* and a switch are connected to the input port of the input-output port 33*b*, and the CPU 30*b* controls each portion connected thereto through a pass in accordance with the control program stored in the ROM 31*b*. Also, the CPU 30*b* has a serial interface function and effects serial communication with the CPU 30*a* of the first sequence sorter and controls each portion by a signal from the first sequence sorter.

Figure 11:
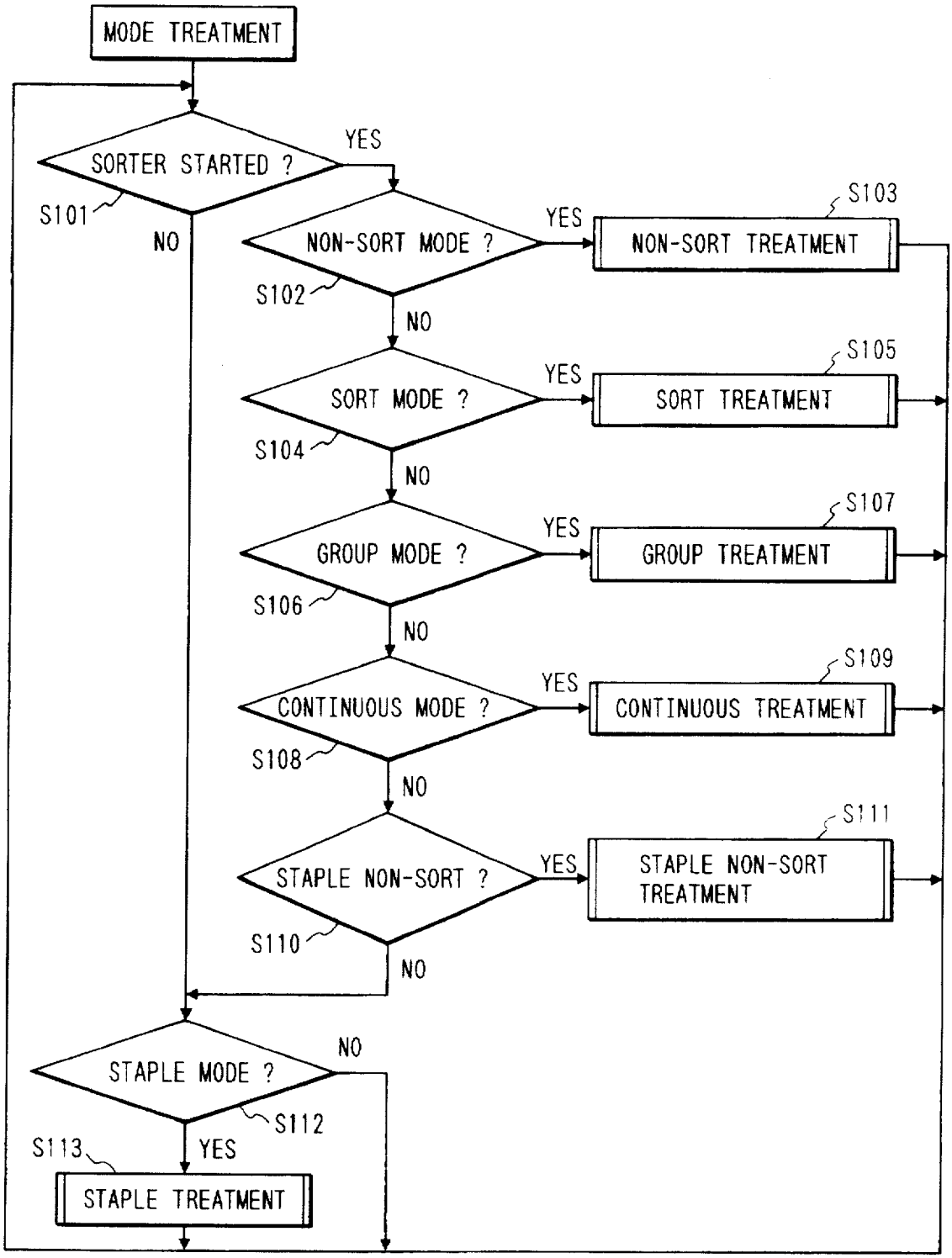
FIG. 11 is a mode treatment flow chart of the entire apparatus.

(10) Control Flow (FIGS. 11 to 19)

a) Mode Treatment (FIG. 11)

The mode treatment which is the general treatment of the present embodiment will first be described with reference to FIG. 11.

At a step S101, the presence or absence of a "sorter start signal" indicative of the sheet discharge from the sheet output apparatus body being started is discriminated, and if the signal is present, advance is made to a step S102. On the other hand, if at the step S101, the "sorter start signal" is absent, the ON/OFF of the manual staple key is checked up at a step S112, and if the manual staple key is ON, a staple treatment step which will be described later is executed, and if the manual staple key is OFF, the treatment is returned to the step S101.

Figure 12:
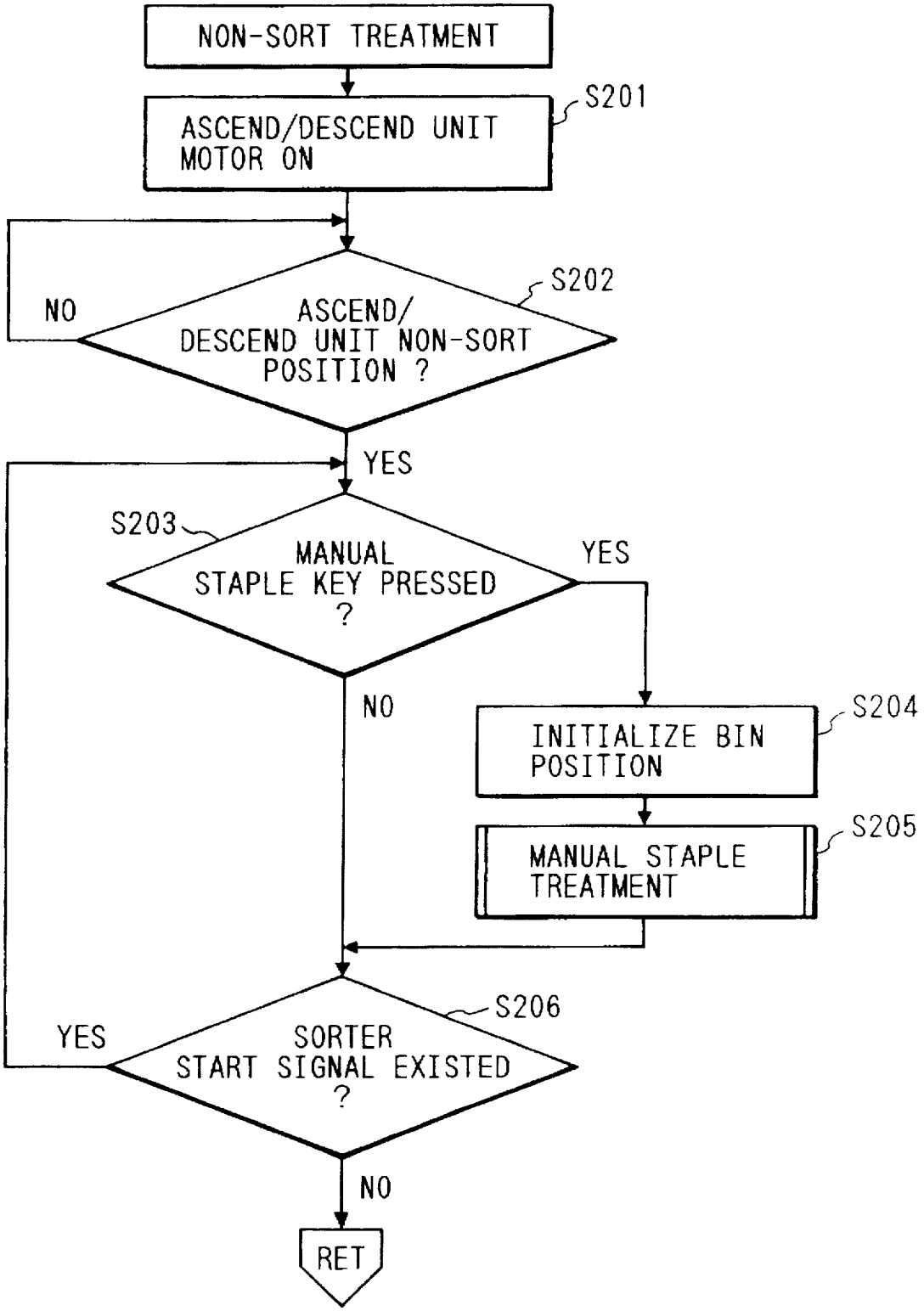
FIG. 12 is a flow chart of the non-sort mode.

At steps S102 to Sill, the discrimination of the mode regarding the reception of the sheets discharged from the sheet output apparatus is effected and advance is made to respective treatments which will be described later, i.e., in the case of the non-sort mode, non-sort treatment which will be described later (steps S102 and S103), in the case of the sort mode, sort treatment which will be described later (steps S104 and S105), in the case of the group mode, group treatment which will be described later (steps S106 and S107), in the case of the continuous mode, continuous treatment which will be described later (steps S108 and S109), in the case of the staple non-sort mode, staple non-sort treatment which will be described later (steps S11O and S11), and in the other case than the above-mentioned cases, advance is made to manual staple treatment (steps S112 and S113). The treatment is returned to the step S101.

b) Non-sort Mode (FIG. 12)

Describing the operation in the aforedescribed non-sort mode with reference to FIG. 12, the motor 39 of the ascend-descend unit 4 of the first intermediate conveying unit 3 is switched on to thereby lower the first intermediate conveying unit 3 to the non-sort position (the first changeover position of FIG. 3A) which is the home position (step S201). Whether the first intermediate conveying unit 3 has come to the non-sort position sensor is checked up by a sensor S1, and if it is in the non-sort position, sheets are discharged from the sheet output apparatus body onto the non-sort tray 32.

Figures 13, 13A:
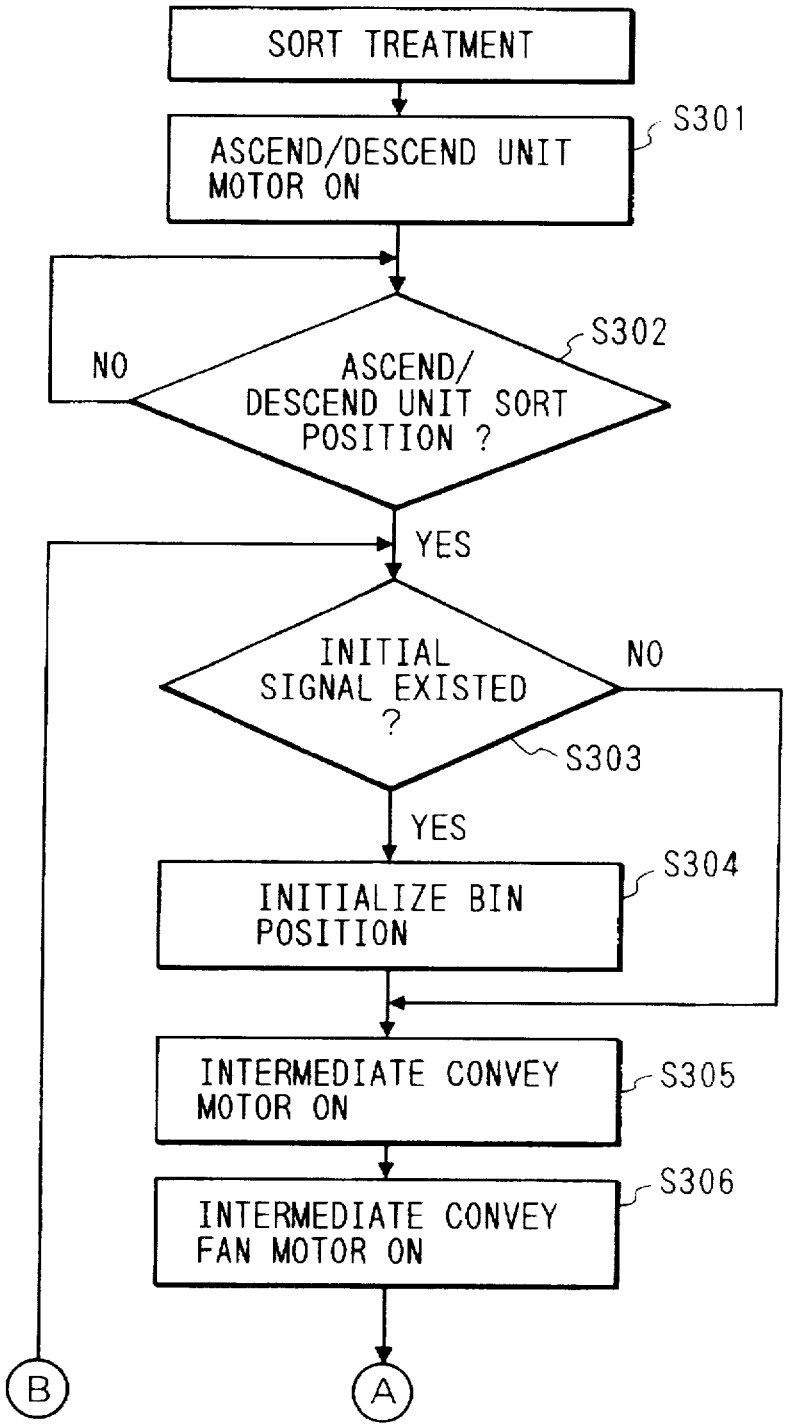
FIG. 13 is comprised of FIGS. 13A and 13B showing flow charts of the sort mode.
Figure 13B:
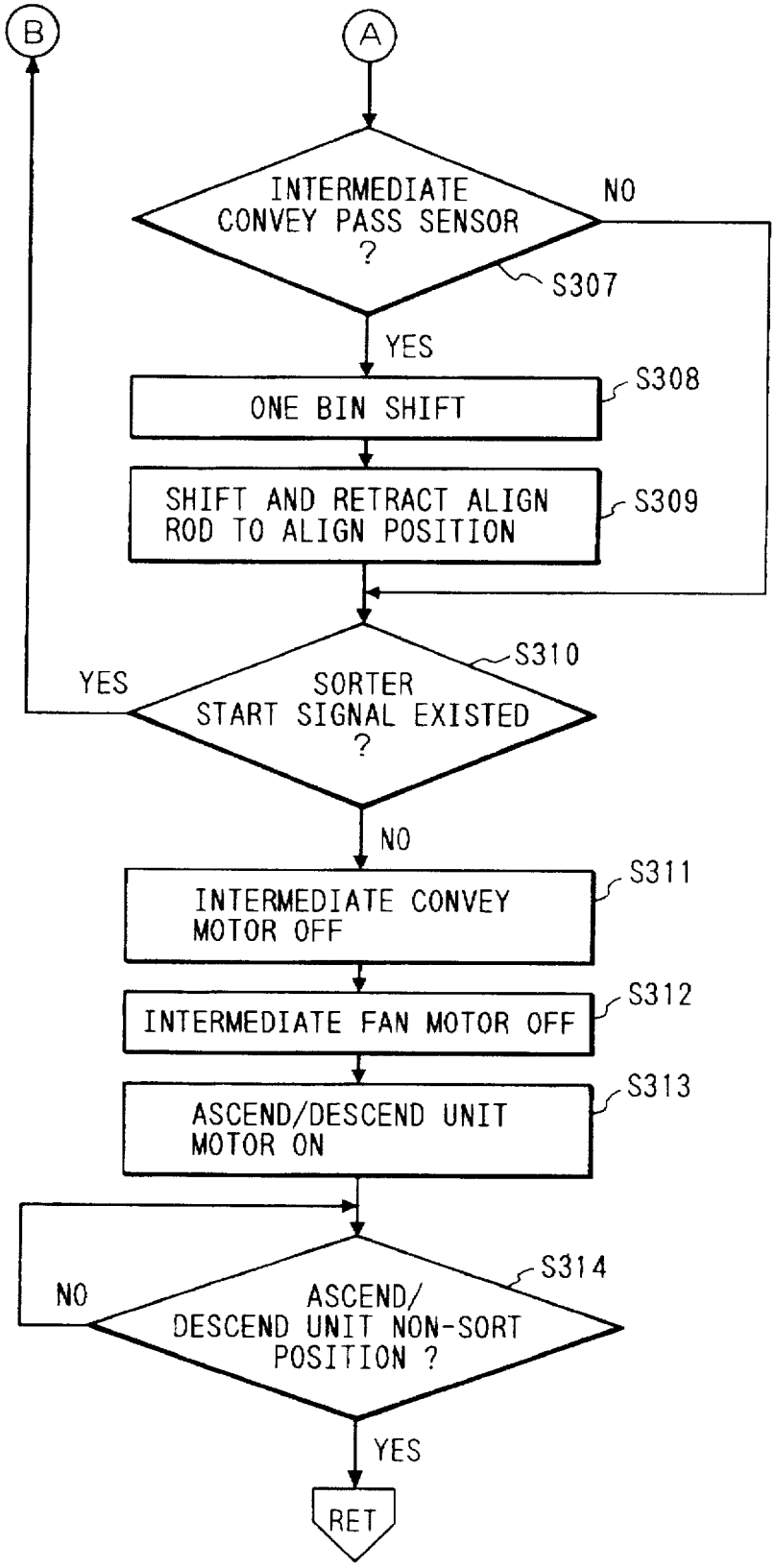

Also, when the manual staple key is depressed during the non-sort mode operation, the bin units are returned to the home position as the initialization of the bins of the sorters, and staple treatment is effected from the first one of the sort bins 8. If the sorter start signal is OFF, non-sort treatment is terminated.

c) Sort Mode (FIGS. 13A and 13B)

Describing the operation in the aforedescribed sort mode with reference to FIGS. 13A and 13B, the motor 39 of the ascend/descend unit 4 of the first intermediate conveying unit 3 is first started (step S301) to thereby move the intermediate conveying unit 3 to the sort position (the second changeover position of FIG. 3B) (step S302). Also, the presence or absence of a "bin initial signal" from the sheet output apparatus body is checked up (step S303), and if the "bin initial signal" is absent, advance is made to a step S305, and if the "bin initial signal" is present, advance is made to a step S305, and if the "bin initial signal" is present, advance is made to a step S304.

At the step S304, as the initialization of the bins, the bin units are lowered to the home position which is the first bin. At the step S305, the intermediate convey motor 40 in the first intermediate conveying unit 3 is started, and at a step S306, the intermediate convey fan 22 is started, and then the check-up of ON/OFF is effected by the intermediate convey pass sensor (step S307). If at the step S307, the intermediate convey pass sensor is not turned on, advance is made to a step S310, and if the intermediate convey pass sensor is turned on, at a step S308, the bin units are shifted by an amount corresponding to one bin while the sheets discharged are placed on the bins and at the same time, the aligning operation of a step S309 is performed.

If the "sorter start signal" is OFF, advance is made to a step S311, where the intermediate convey motor 40 is stopped, and at a step S313, the intermediate convey fan 22 is stopped.

Figures 14, 14A:
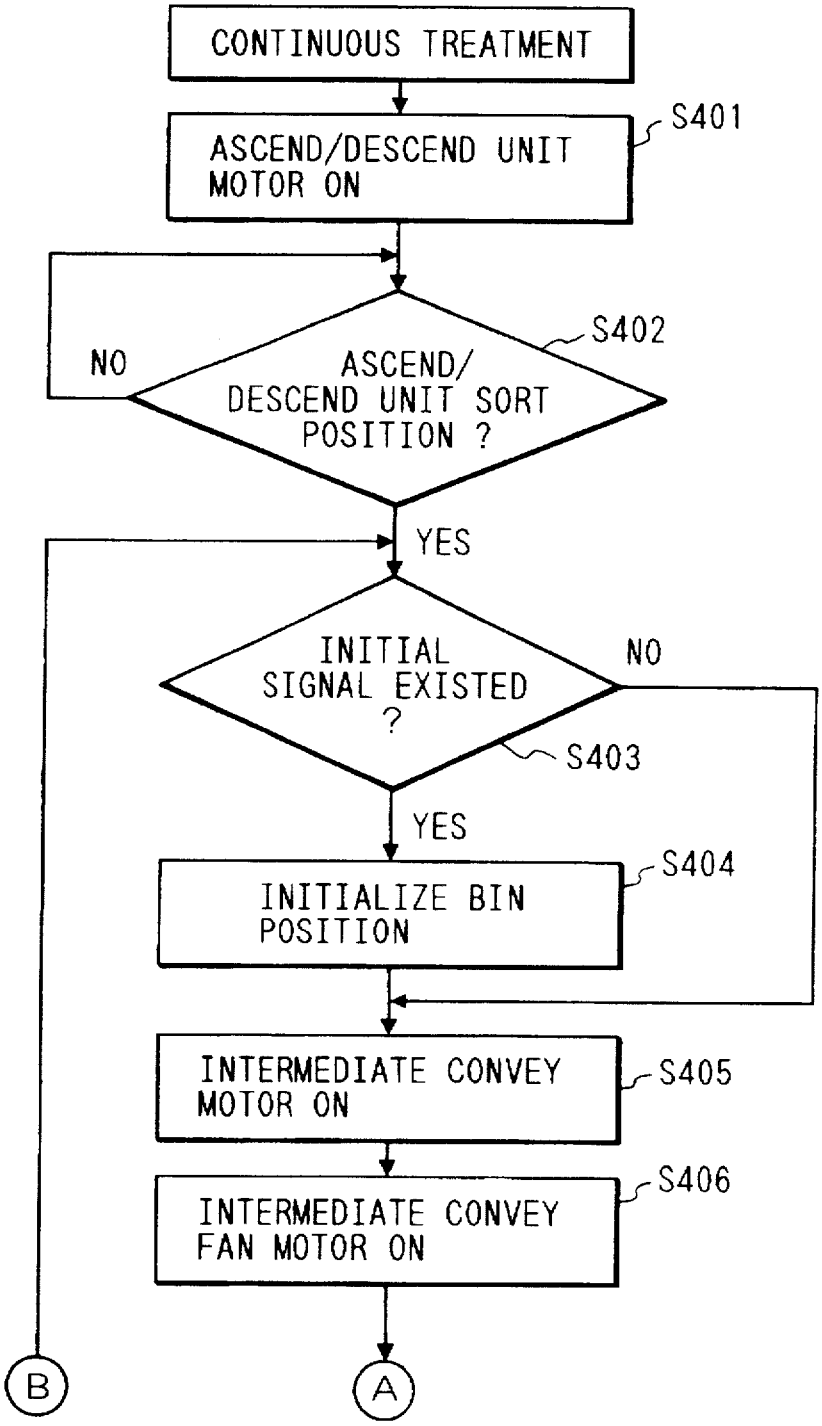
FIG. 14 is comprised of FIGS. 14A and 14B showing flow charts of the continuous mode.

Subsequently, the first intermediate conveying unit 3 is moved to the non-sort position (FIG. 3A) by the ascend/descend unit 4, thus terminating the nonsort treatment.

d) Continuous Mode (FIGS. 14A and 141)

Figure 14B:
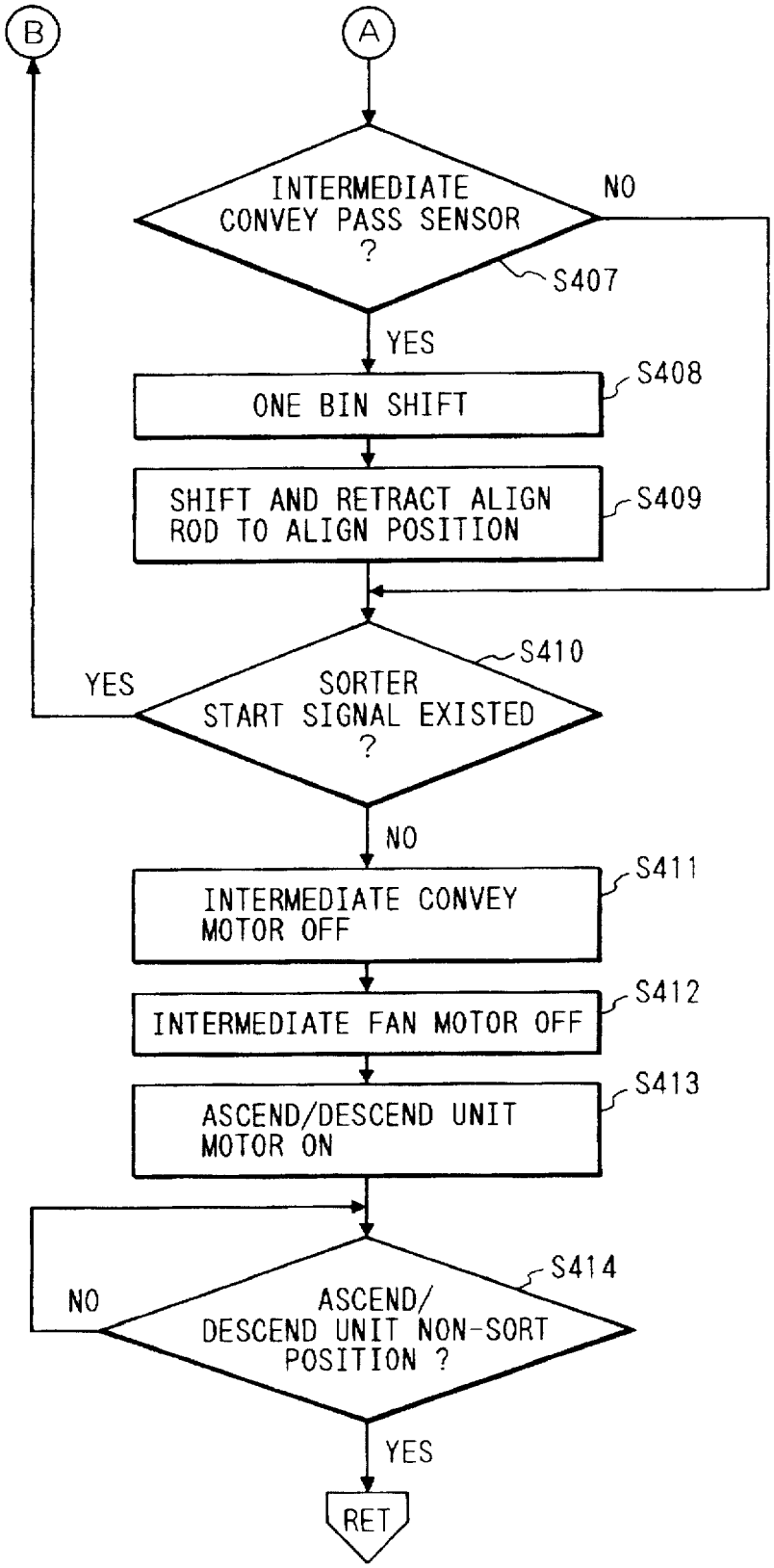

Describing the operation in the aforedescribed continuous mode with reference to FIGS. 14A and 14B, the motor 39 of the ascend/descend unit 4 of the first intermediate conveying unit 3 is first started (step S401) to thereby move the first intermediate conveying unit 3 to the sort position (FIG. 3B) (step S402). Also, the presence or absence of the "bin initial signal" from the sheet output apparatus body is checked up (step S403), and if the "bin initial signal" is absent, advance is made to a step S405, and if the "bin initial signal" is present, advance is made to a step S404.

At the step S404, as the initialization of the bins, the bin units are lowered to the home position which is the first bin. At the step S405, the intermediate convey motor 40 in the first intermediate conveying unit 3 is started, and at a step S406, the intermediate convey fan 22 is started, and then the check-up of ON/OFF is effected by the intermediate convey pass sensor (step S407).

If at the step S407, the intermediate convey pass sensor is not turned on, advance is made to a step S410, and if the intermediate convey pass sensor is turned on, at a step S408, the bin units are shifted by an amount corresponding to one bin while the discharged sheets are placed on the bins and at the same time, the aligning operation of a step S409 is performed. If the "sorter start signal" is OFF, advance is made to a step S411, where the intermediate convey motor 40 is stopped, and at a step S413, the intermediate convey fan 22 is stopped.

Figures 15, 15A:
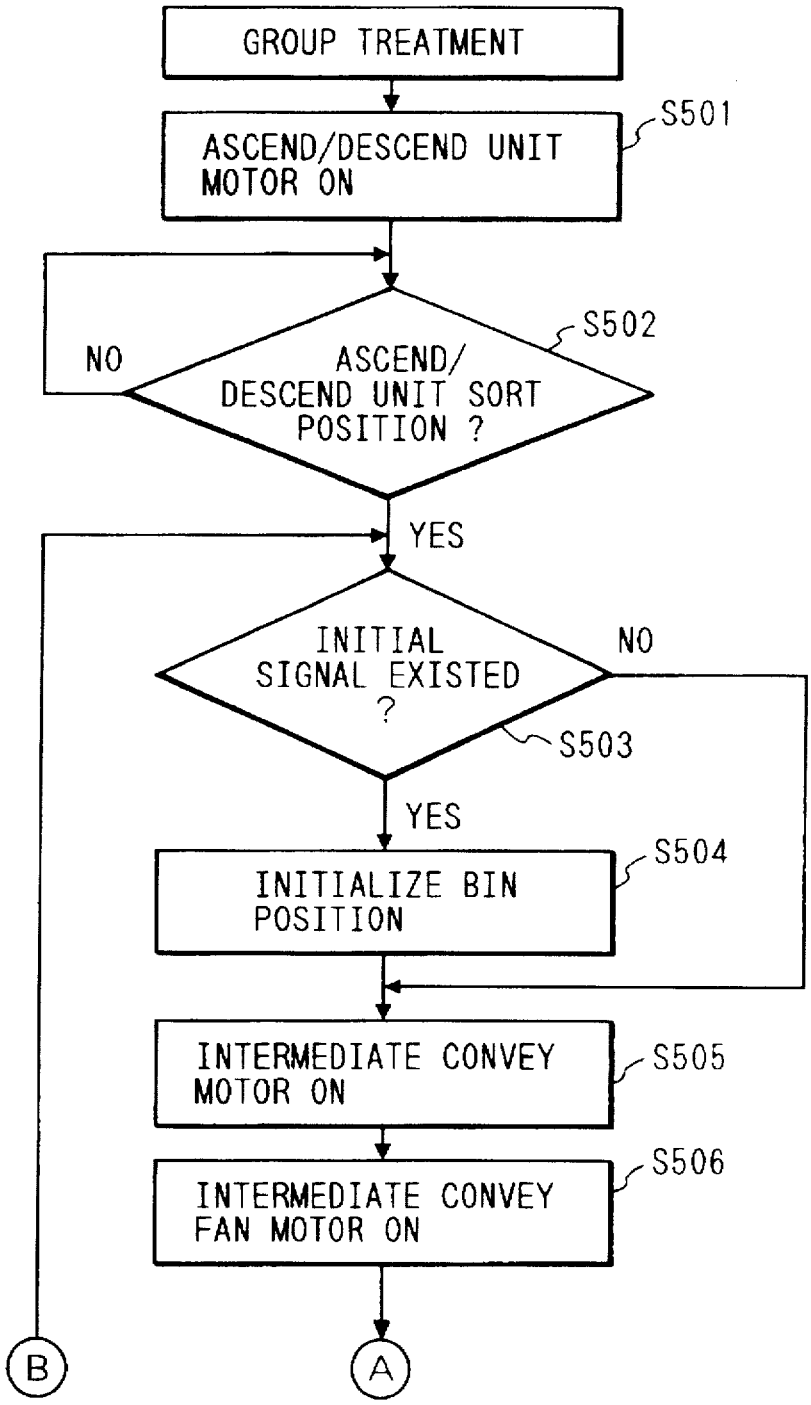
FIG. 15 is comprised of FIGS. 15A and 15B showing flow charts of the group mode.
Figure 15B:
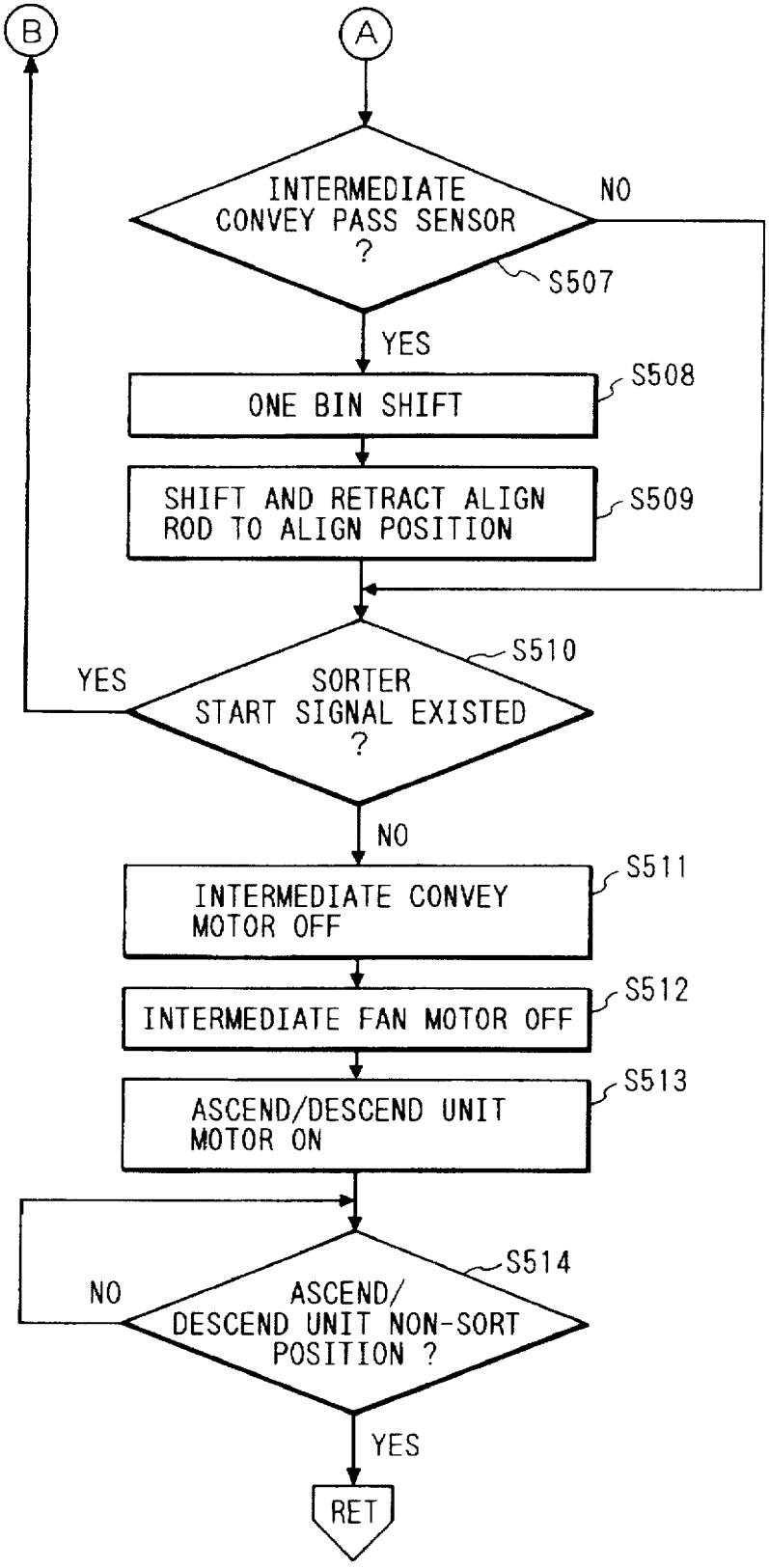

Subsequently, the first intermediate conveying unit 3 is moved to the non-sort position by-the ascend/descend unit 4, thus terminating the non-sort treatment.

e) Group Mode (FIGS. 15A and 15B)

Describing the operation in the aforedescribed group mode with reference to FIGS. 15A and 15B, the motor 39 of the ascend/descend unit 4 of the first intermediate conveying unit 3 is first started (step S501) to thereby move the first intermediate conveying unit to the sort position (FIG. 3B) (step S502). Also, the presence or absence of the "bin initial signal" from the sheet output apparatus body is checked up (step S503), and if the "bin initial signal" is absent, advance is made to a step S505, and if the "bin initial signal" is present, advance is made to a step S504.

At the step S504, as the initialization of the bins, the bin units are lowered to the home position which is the first bin. At the step S505, the intermediate convey motor 40 in the first intermediate conveying unit 3 is started, and at a step S506, the intermediate convey fan 22 is started, and subsequently, at a step S507, the check-up of ON/OFF is effected by the intermediate convey pass sensor.

If at the step S507, the intermediate convey pass sensor is not turned on, advance is made to a step S510, and if the intermediate convey pass sensor is turned on, at a step S508, the bin units are shifted by an amount corresponding to one bin while the discharged sheets are placed on the bins and at the same time, the aligning operation of a step S509 is performed. If the "sorter start signal" is OFF, advance is made to a step S511, where the intermediate convey motor 40 is stopped, and at a step S513, the intermediate convey fan 22 is stopped.

Figure 16:
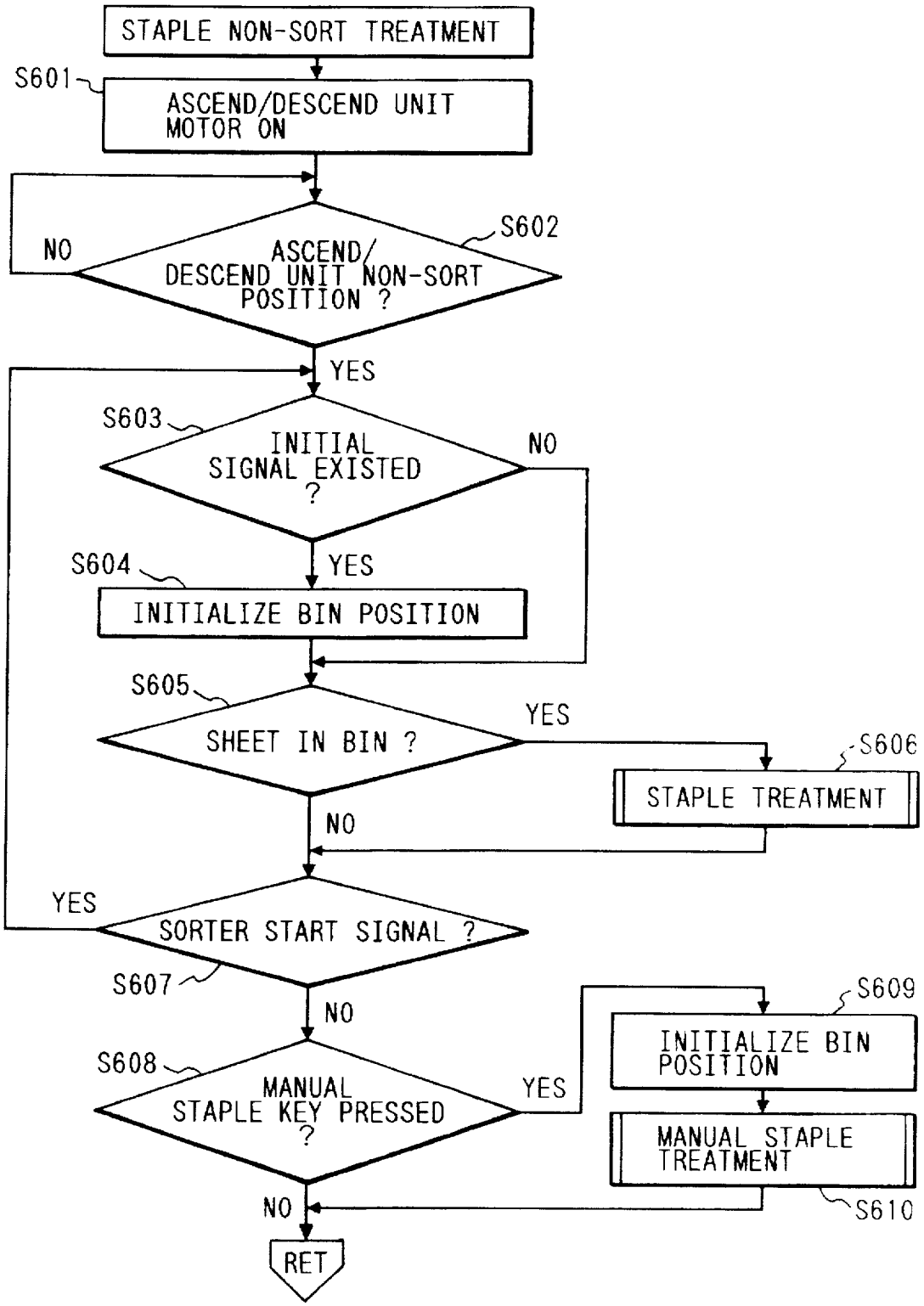
FIG. 16 is a flow chart of the staple mode.

Subsequently, the first intermediate conveying unit 3 is moved to the non-sort position (FIG. 3A) by the ascend/descend unit 4, thus terminating the non-sort treatment.

f) Staple Non-sort (FIG. 16)

This is staple non-sort in which the non-sort mode and the auto staple mode are permitted and parallel operations are made possible.

Describing the operation of the aforedescribed staple non-sort with reference to FIG. 16, the motor 40 of the ascend/descend unit 4 in the first intermediate conveying unit 3 is first actuated (step S601) to thereby move the first intermediate conveying unit 3 to the non-sort position (FIG. 3A). During the movement of this intermediate conveying unit 3, the bin units in the sorters are moved to the first bin which is the home position.

Figure 17:
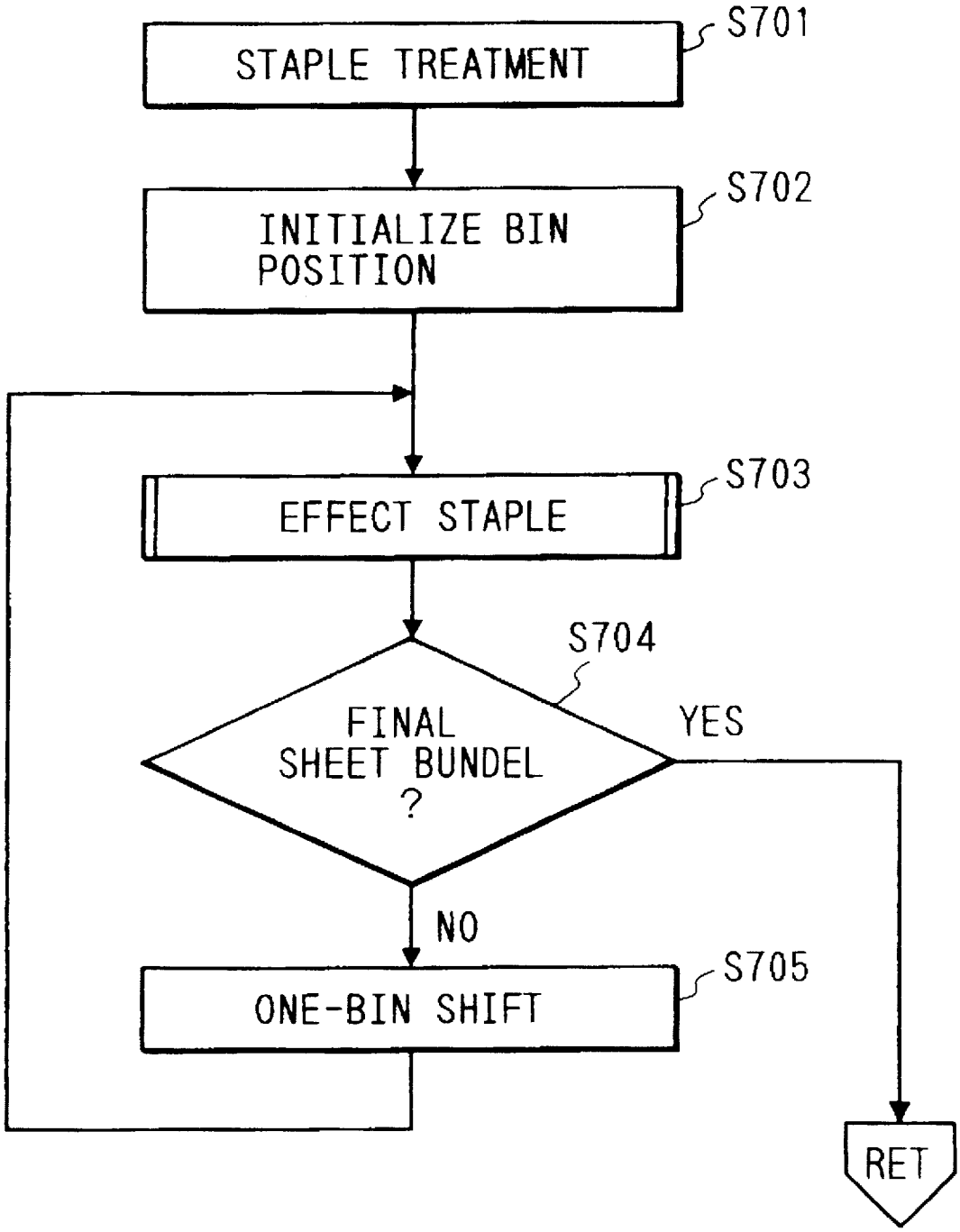
FIG. 17 is a flow chart (1) of the staple treatment.
Figure 18:
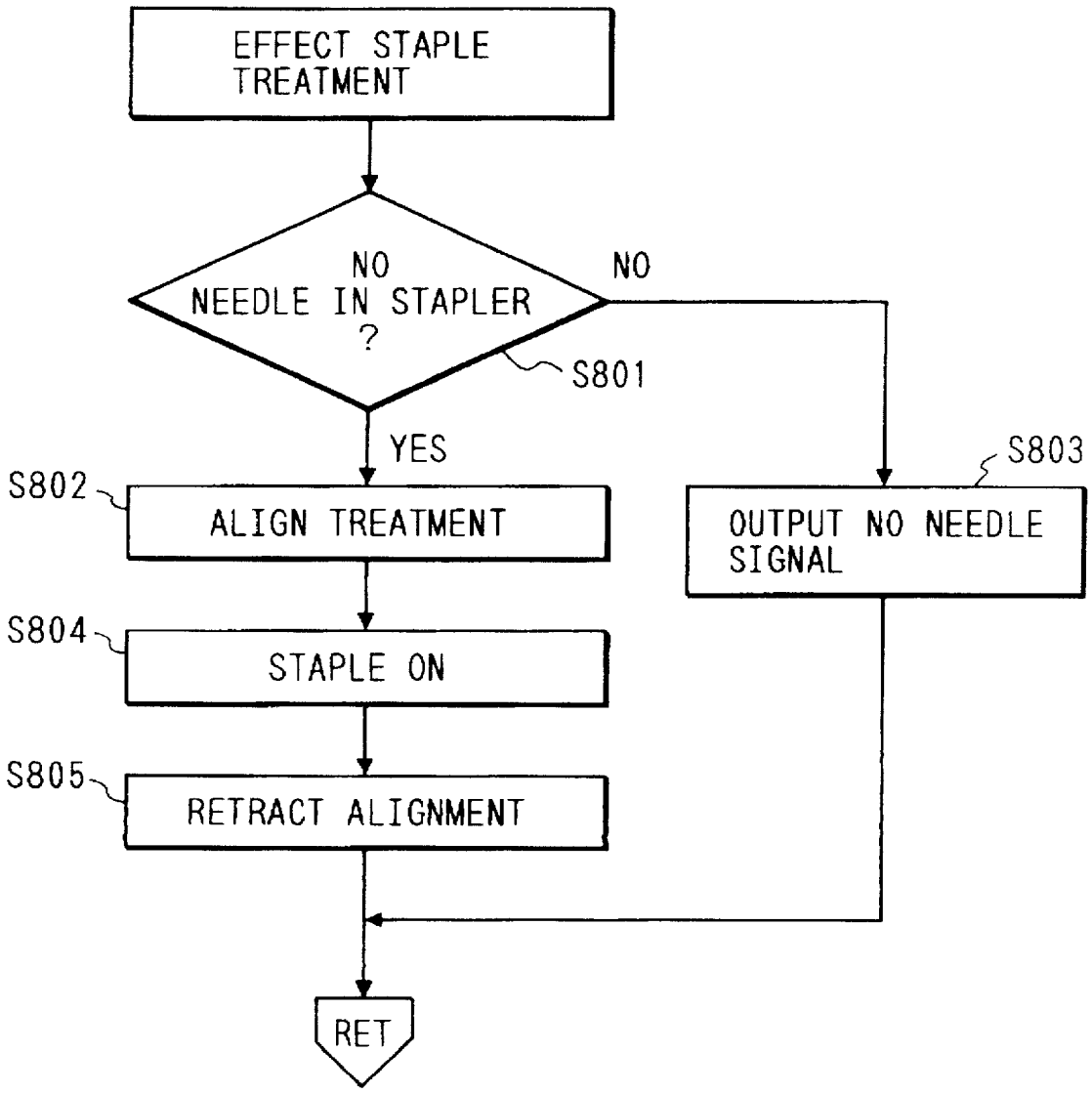
FIG. 18 is a flow chart (2) of the staple treatment.

At a step S605, the presence or absence of sheets on the bins is checked up, and if at the step S605, sheets are present, staple treatment is effected, and at the step S605, sheets are absent, at a step S607, the check-up of the manual staple key is effected. Consequently, if the sheets discharged from the sheet output apparatus 1 when the first intermediate conveying unit 3 has been set at the non-sort position are discharged onto the non-sort tray 32 of the intermediate conveying unit 3 and at the same time, sheet bundles are discharged into the plurality of sort bins 8 of the sorters 2 and 6, staple is made possible by the stapler units 14 in the sorters 2 and 6.

g) Staple Treatment (FIGS. 17 and 18)

Staple treatment will now be described with reference to FIG. 17 which shows the flow of the staple treatment.

First, at a step S702, the initialization of the bin position for a series of staple treatments is effected. The initialized bin position is moved to the first bin which is the home position. Next, the staple executing treatment of a step S703 is designated by mode data sent from the body by the aforedescribed serial communication. The details of this staple executing treatment step S703 will be described later (FIG. 18).

When staple is terminated at the step S703, the program proceeds to a step S704, where whether the bundle which has been stapled is the last bundle in the series of staple treatments is judged. If it is the last bundle, staple treatment is terminated, but if it is not the last bundle, one bin shift is effected, whereafter return is made to the step S703, where the treatment is executed.

FIG. 8 shows the detailed flow of the above-described staple executing treatment step S703, and at a step S801, whether there is a needle in the stapler is judged. The stapler 14 is used in the binding operation, and a no-needle detecting sensor 64 is used for the judgement of the presence or absence of a needle. If there is a needle, the program proceeds to a step S802, where the sheet bundle is held down by an aligning rod so as not to deviate. The program then proceeds to a step S804, where stapling is effected, and at a step S805, the aligning rod is retracted, thus terminating the staple treatment.

Figure 19:
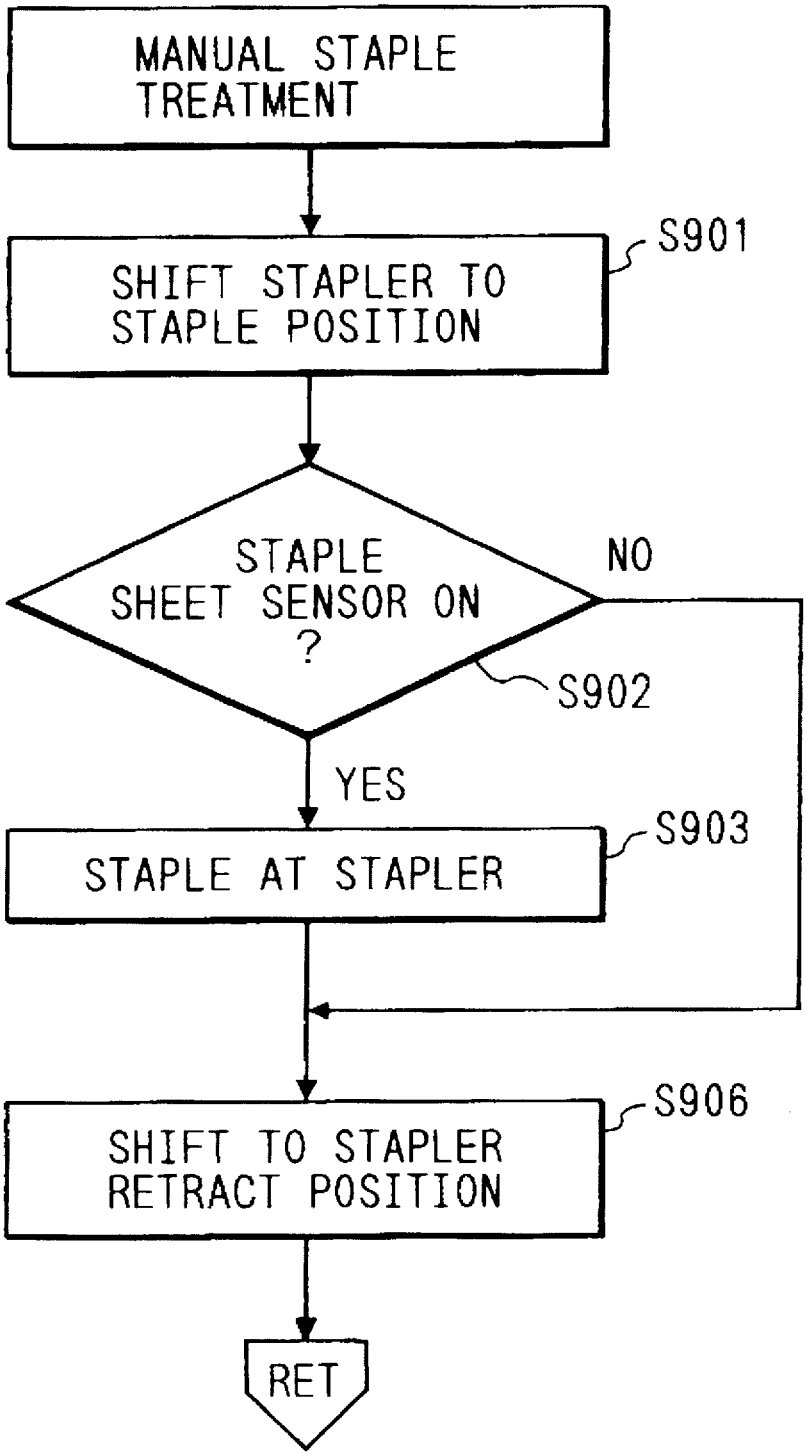
FIG. 19 is a flow chart of the manual staple operation.
Figure 20:
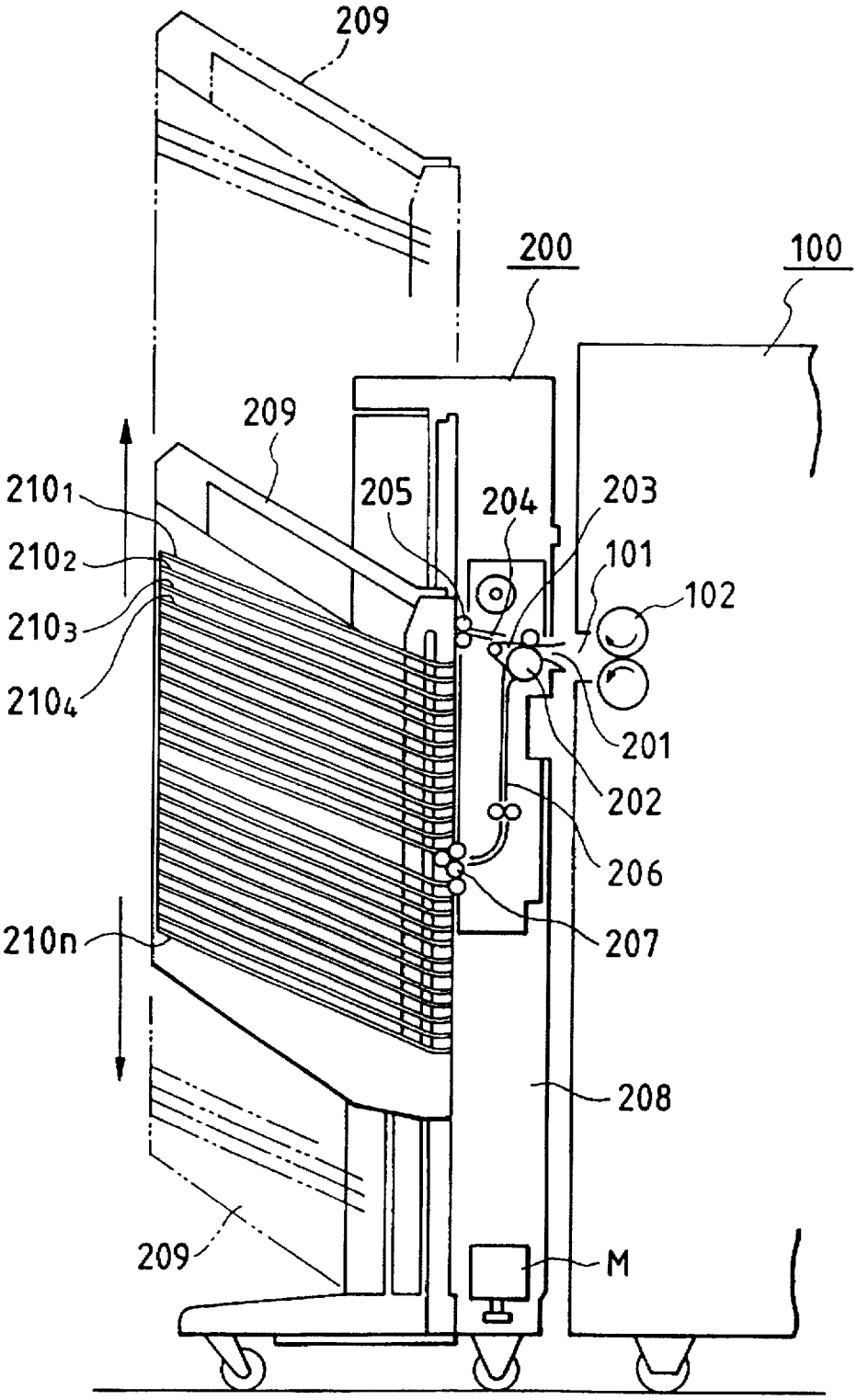
FIG. 20 PRIOR ART
FIG. 20 schematically shows the construction of an apparatus according to the prior art.

However, if at the step S801, it is judged that there is no needle, the program proceeds to a step S803, where a no-needle alarm is outputted to the body, thus terminating the treatment. When there is no needle, the treatment can be terminated without the staple treatment being effected, thereby changing over the mode to a mode in which the staple treatment is not effected.

h) Manual Staple Operation (FIG. 19)

The manual staple operation will now be described with reference to FIG. 19. The manual staple is a mode in which sheet bundles inserted into the bins by the user are stapled, and the stapling of one bin only is effected in this mode.

At a step S901, the stapler 14 is moved to a staple position. When the movement is completed, whether there is paper at the portion of the stapler is judged by a staple paper sensor located near the stapler. If there is paper, the program proceeds to a step S903, where stapling is effected by the stapler.

If at a step S902, it is judged there is no paper at the portion of the stapler, or after at the step S903, stapling is terminated, the program proceeds to a step S904. At the step S904, the stapler is moved to its retracted position, thus terminating the treatment.

Next, in the first and second sequence sorters 2 and 6, there is a case where the stapler cannot be driven depending on the thickness of the sheet bundle when the stapling of the sheet bundle is effected, and a flag (not shown) occurs as needle jam in the control device in the sorters. The flag is transferred to the sheet output apparatus body by serial communication. The flag of the needle jam remains ON in the control device in the sorters and therefore, the staple mode, etc. from the sheet output apparatus cannot be controlled.

Consequently, the flag of a needle jam release signal is stood up from the control device of the sheet output apparatus, and the flag of the needle jam is cleared by the control device of the sorters through mutual serial communication. By the flag of the needle jam in the sorters being cleared, the mode, etc. from the sheet output apparatus can be controlled.

In the above-described embodiment, the sorters are not restricted to those as shown in the embodiment. Further, the sheet bundle binding means is not restricted to the stapler, but may conveniently be, for example, means having perforating means and means for forming perforations in the perforating means and fitting a binding tool in the perforations, or means using paste. The construction of the first and second intermediate conveying units 3 and 5 is neither restricted to that of the embodiment.

What is claimed is:

1. A sheet post-treatment apparatus comprising:

a sorting apparatus for containing sheets in a plurality of sort bins;

connecting means for introducing sheets discharged into said sorting apparatus;

a sheet discharge tray for non-sort provided independently of said sorting apparatus for piling thereon the sheets discharged; and changeover means for selectively changing over a first mode for introducing the sheets discharged into said sorting apparatus through said connecting means for sort, and a second mode for introducing them into said sheet discharge tray for non-sorts;

wherein said connecting means is provided upstream of said sorting apparatus said sheet discharge tray for non-sort is overlapped with said connecting means, and said connecting means and said sheet discharge tray for non-sort are lifted or lowered so that said connecting means receives the sheet discharged upon sort, and said sheet discharge tray receives the sheet discharged upon non-sort.

2. A sheet post-treatment apparatus comprising:

a sorting apparatus for containing sheets in a plurality of sort bins;

connecting means for introducing sheets discharged into said sorting apparatus;

a sheet discharge tray for non-sort provided independently of said sorting apparatus for piling thereon the sheets discharged; and changeover means for selectively changing over a first mode for introducing the sheets discharged into said sorting apparatus through said connecting means for sort, and a second mode for introducing them into said sheet discharge tray for non-sort;

wherein when the second mode in which the sheets are piled onto the discharge tray for non-sort is selected, the sheet bundle is manually insertable to the sort bin of said sorting apparatus for binding by staple means.

3. A sheet post-treatment apparatus comprising:

a sorting apparatus for containing sheets in a plurality of sort bins;

connecting means for introducing sheets discharged into said sorting apparatus;

a sheet discharge tray for non-sort provided independently of said sorting apparatus for piling thereon the sheets discharged; and changeover means for selectively changing over a first mode for introducing the sheets discharged into said sorting apparatus through said connecting means, and a second mode for introducing them into said sheet discharge tray for non-sort;

wherein after the sheets are piled in said plurality of sort bins and the last sheet is piled in the first mode, and when the sheet bundle is being bound by staple means, said sheet post-treatment apparatus can pile and contain the sheets in said sheet discharge tray for non-sort.

4. A sheet post-treatment apparatus according to claim 3, wherein the sheet pile and contain operation is started by manually operating a manual button.

5. A sheet post-treatment apparatus according to claim 1, wherein said sorting apparatus are returned to a predetermined position, after completion of the sort operation by said sorting apparatus and before the bind operation by said binding means is started.

6. A sheet post-treatment apparatus according to claim 1, further comprising binding means for binding sheet bundles contained on said sort bins, first warning means for sending a needle jam signal produced in said binding means to said sheet output apparatus, and second warning means for receiving a needle jam release signal from said sheet output apparatus for sheet post-treatment.

7. An image forming apparatus, comprising:

image forming means;

a sorting apparatus for containing sheets in a plurality of sort bins;

connecting means for introducing the sheets on which an image is formed into the sorting apparatus;

a sheet discharge tray for non-sort provided independently of said sorting apparatus for piling thereon the sheets on which the image is formed; and changeover means for selectively changing over a first operation mode for introducing the sheets on which the image is formed into said sorting apparatus through said connecting means for sort, and a second operation mode for introducing them into said sheet discharge tray for non-sorts;

wherein said connecting means is provided upstream of said sorting apparatus, said sheet discharge tray for non-sort is overlapped with said connecting means, and said connecting means and said sheet discharge tray for non-sort are lifted or lowered so that said connecting means receives the sheet discharged upon sort, and said sheet discharge tray receives the sheet discharged upon non-sort.

8. An image forming apparatus, comprising:

image forming means;

a sorting apparatus for containing sheets in a plurality of sort bins;

connecting means for introducing the sheets on which an image is formed into the sorting apparatus;

a sheet discharge tray for non-sort provided independently of said sorting apparatus for piling thereon the sheets on which the image is formed; and changeover means for selectively changing over a first operation mode for introducing the sheets on which the image is formed into said sorting apparatus through said connecting means for sort, and a second operation mode for introducing them into said sheet discharge tray for non-sort;

wherein when the second operation mode in which the sheets are piled onto the discharge tray for non-sort is selected, the sheet bundle is manually insertable to the sort bin of said sorting apparatus for binding by staple means.

9. An image forming apparatus, comprising:

image forming means;

a sorting apparatus for containing sheets in a plurality of sort bins;

connecting means for introducing the sheets on which an image is formed into the sorting apparatus;

a sheet discharge tray for non-sort provided independently of said sorting apparatus for piling thereon the sheets on which the image is formed; and changeover means for selectively changing over a first operation mode for introducing the sheets on which the image is formed into said sorting apparatus through said connecting means for sort, and a second operation mode for introducing them into said sheet discharge tray for non-sort;

wherein after the sheets are piled in said plurality of sort bins and the last sheet is piled in the first operation mode, and when the sheet bundle is being bound by staple means, said sheet post-treatment apparatus can pile and contain the sheets in said sheet discharge tray for non-sort.

10. An image forming apparatus, according to claim 9, wherein the sheet pile and container operation is started by manually operating a manual button.

11. A sheet post-treatment apparatus according to claim 1, wherein said connecting means has belt means.

12. A sheet post-treatment apparatus according to claim 11, wherein said belt means and said discharge sheet tray are lifted or lowered by being guided by a guide of the body of said apparatus.

13. A sheet post-treatment apparatus according to claim 12, wherein at the lifted position of said belt means, a downstream side thereof faces to an entrance of said sorting apparatus.

14. A sheet post-treatment apparatus according to claim 13, wherein said discharge sheet tray and said belt means are protruded like a bridge from a side face of the upstream side of the body of said apparatus.

15. A sheet post-treatment apparatus according to claim 14, wherein said sort bins are lifted or lowered one by one relative to the entrance opposing to said connecting means.

16. A sheet post-treatment apparatus according to claim 2, wherein said staple means is disposed at a position opposing to one of said sort bins of said sorting apparatus.

17. A sheet post-treatment apparatus according to claim 3, wherein said staple means is disposed at a position opposing to one of said sort bins of said sorting apparatus.

18. A sheet post-treatment apparatus according to claim 4, wherein said staple means is disposed at a position opposing to one of said sort bins of said sorting apparatus.

19. A sheet post-treatment apparatus according to claim 5, wherein said staple means is disposed at a position opposing to one of said sort bins of said sorting-apparatus.

20. A sheet post-treatment apparatus according to claim 6, wherein said staple means is disposed at a position opposing to one of said sort bins of said sorting apparatus.

21. A sheet post-treatment apparatus according to claim 3, wherein said sheet pile and contain operation is started automatically based on a command set in advance.

22. A sheet post-treatment apparatus comprising:

a sorting apparatus for containing sheets in a plurality of sort bins;

connecting means for introducing the sheets discharged into said sorting apparatus;

a sheet discharge tray for non-sort provided independently from said sorting apparatus for piling thereon the sheets discharged; and changeover means for selectively changing over between a first mode for introducing the sheets discharged into said sorting apparatus through said connecting means for sort, and a second mode for introducing the sheets discharged into said sorting apparatus into said sheet discharge tray for non-sort, wherein sheet discharge to the discharge tray for non-sort and staple operation by staple means are effected in parallel.

23. A sheet post-treatment apparatus according to claim 1, wherein in the second mode in which the sheets are piled onto the discharge tray for non-sort is selected, the sheet bundle is manually inserted to the sort bin of said sorting apparatus to be bound by staple means.

24. A sheet post-treatment apparatus according to claim 1, wherein the first or second mode can be changed, by manually operating said changeover means, to a third mode in which after completion of the sorting by said sorting apparatus, the sheets are bound by staple means and said sorting apparatus, while the sheet is piled and contained in said sheet discharge tray for non-sort.

25. A sheet post-treatment apparatus according to claim 1, wherein the first or second mode can be changed by said changeover means to a third mode in which a sheet binding by staple means and by said sorting means, and a sheet discharge to said sheet discharge tray are effected in parallel.

26. A sheet post-treatment apparatus according to claim 5, wherein said sorting apparatus moves upwardly from the lowermost position to the uppermost position upon sorting, and returns to the lowermost position before start of the bind operation.

27. A sheet post-treatment apparatus according to claim 26, when said sheet post-treatment apparatus effects the sort operation alone, said sorting apparatus stops at the uppermost position.

* * * * *

UNITED STATES PATENT AND TRADEMARK OFFICE

CERTIFICATE OF CORRECTION

PATENT NO. : 5,752,694 Page 1 of 2

DATED : May 19, 1998

INVENTOR(S) : Hirofumi YAMASHITA, et al.

It is certified that error appears in the above-identified patent and that said Letters Patent is hereby corrected as shown below:

ON THE COVER PAGE

AT Reference [73] Assignees:

"Ibaraki-ken;" should read --Mitsukaido;--.

[57] Abstract:
Line 7,
"bewteen" should read --between--.

On drawing
SHEET 21 of 24

Fig. 17, "BUNDEL" should read --BUNDLE--.

COLUMN 13:

Line 34, "Sill," should read --S111,--.
Line 48, "S11)," should read --S111),--.

COLUMN 14:

Line 37, "141)" should read --14B)--.

UNITED STATES PATENT AND TRADEMARK OFFICE

CERTIFICATE OF CORRECTION

PATENT NO. : 5,752,694 Page 2 of 2

DATED : May 19, 1998

INVENTOR(S) : Hirofumi YAMASHITA, et al.

It is certified that error appears in the above-identified patent and that said Letters Patent is hereby corrected as shown below:

COLUMN 17:

Line 14, "non-sorts; should read --non-sort;--.

COLUMN 18:

Line 3, "on" should read --in--.

COLUMN 20:

Line 19, "is selected" should be deleted.

Signed and Sealed this

Twenty-ninth Day of December, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,752,694

DATED : May 19, 1998

INVENTORS : HIROFUMI YAMASHITA, ET AL.

It is certified that error appears in the above-identified patent and that said Letters Patent is hereby corrected as shown below:

ON THE TITLE PAGE:

Item [73] ASSIGNEES,
"Mitsukaido" should read --Ibaraki-ken--.

COLUMN 18,
Line 4, "said" (second occurrence) should read --a--.

COLUMN 20,
Line 13, "into said sorting apparatus" should be deleted; and
Line 20, "is selected" should be deleted.

Signed and Sealed this

Sixteenth Day of May, 2000

*Attest:*

Q. TODD DICKINSON

*Attesting Officer*

*Director of Patents and Trademarks*